US011150013B2

(12) United States Patent
Yamade et al.

(10) Patent No.: US 11,150,013 B2
(45) Date of Patent: Oct. 19, 2021

(54) REFRIGERATOR

(71) Applicant: SHARP KABUSHIKI KAISHA, Sakai (JP)

(72) Inventors: Kinya Yamade, Sakai (JP); Hiroshi Hisahara, Sakai (JP); Yoshihiko Hamaguchi, Sakai (JP); Sadahiko Hinoue, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 61 days.

(21) Appl. No.: 16/287,609

(22) Filed: Feb. 27, 2019

(65) Prior Publication Data

US 2020/0003484 A1 Jan. 2, 2020

(30) Foreign Application Priority Data

Jun. 29, 2018 (JP) ..... JP2018-125221

(51) Int. Cl.
*F25D 29/00* (2006.01)
*F25D 17/04* (2006.01)
*F25D 23/04* (2006.01)

(52) U.S. Cl.
CPC ..... *F25D 29/005* (2013.01); *F25D 17/045* (2013.01); *F25D 23/04* (2013.01); *F25D 2323/06* (2013.01); *F25D 2500/04* (2013.01); *F25D 2700/06* (2013.01)

(58) Field of Classification Search
CPC ..... F25D 23/06; F25D 23/04; F25D 27/00; F25D 29/003; F25D 29/005; H04N 5/2256
See application file for complete search history.

(56) References Cited

U.S. PATENT DOCUMENTS 10,139,150 B2 * 11/2018 de Cavalcanti ..... F25D 17/042
2006/0096303 A1 * 5/2006 Kavounas ..... F25D 29/00 62/125
2009/0277210 A1 * 11/2009 Eveland ..... F25D 23/028 62/441
2014/0293060 A1 * 10/2014 Ryu ..... F25D 29/00 348/159
2014/0300265 A1 * 10/2014 Lee ..... F25D 23/12 312/405.1

(Continued)

FOREIGN PATENT DOCUMENTS

CN 104075518 A 10/2014
CN 105184231 A 12/2015

(Continued)

*Primary Examiner* — Nelson J Nieves
*Assistant Examiner* — Meraj A Shaikh
(74) *Attorney, Agent, or Firm* — ScienBiziP, P.C.

(57) ABSTRACT

A refrigerator includes a storage compartment, a door, an air outlet, an imaging unit, and a determination unit. The storage compartment has a storage region that stores a stored object. The door opens and closes the storage compartment. The air outlet is provided in a rear wall of the storage region and blows cold air into the storage region. The imaging unit is provided at an inner side of the door at a position higher than or equal to a height of the air outlet and acquires an image of the storage region from the door. The determination unit determines an arrangement state of the stored object stored in the storage region based on the image acquired by the imaging unit.

10 Claims, 21 Drawing Sheets

(56) References Cited

U.S. PATENT DOCUMENTS

| | | | | |
|---|---|---|---|---|
| 2015/0248612 | A1 | 9/2015 | Morimoto et al. | |
| 2016/0146527 | A1* | 5/2016 | Kim | F25D 29/00 312/404 |
| 2017/0041520 | A1* | 2/2017 | Carlotto | H04N 5/2256 |

FOREIGN PATENT DOCUMENTS

| | | | |
|---|---|---|---|
| EP | 3128273 | A1 | 2/2017 |
| JP | H05-045042 | A | 2/1993 |
| TW | 201510752 | A | 3/2015 |
| TW | I652440 | B | 3/2019 |

* cited by examiner

REFRIGERATOR

BACKGROUND

1. Field

The present disclosure relates to refrigerators.

2. Description of the Related Art

Japanese Unexamined Patent Application Publication No. 5-45042 discloses a technology that recognizes an image inside a refrigerator and warns a user by displaying a warning on a display device if the refrigerator is used inappropriately. In this technology, a camera set at an upper rear side of the refrigerator, as viewed from the door thereof, is used to acquire an image below the camera, and image recognition is performed on the obtained image.

However, with the camera described in Japanese Unexamined Patent Application Publication No. 5-45042, it is difficult to check whether a passage for allowing cold air discharged from an air outlet to circulate through the refrigerator is ensured. Moreover, because the camera is set at the rear side of the refrigerator, the camera may possibly occupy a food storage region. Furthermore, it is difficult to utilize this camera for purposes other than those disclosed in Japanese Unexamined Patent Application Publication No. 5-45042. For example, the camera is not suitable for acquiring a wide-angle image inside the refrigerator for managing, for example, food stored in the refrigerator. Therefore, an additional camera that is capable of acquiring a wide-angle image inside the refrigerator has to be set in the refrigerator. This may be problematic in terms of cost versus performance.

It is desirable to achieve a refrigerator that may prompt a user to ensure a cold-air circulation passage in the refrigerator with a simple configuration.

SUMMARY

According to an aspect of the disclosure, there is provided a refrigerator including a storage compartment, a door, an air outlet, an imaging unit, and a determination unit. The storage compartment has a storage region that stores a stored object. The door opens and closes the storage compartment. The air outlet is provided in a rear wall of the storage region and blows cold air into the storage region. The imaging unit is provided at an inner side of the door at a position higher than or equal to a height of the air outlet and acquires an image of the storage region from the door. The determination unit determines an arrangement state of the stored object stored in the storage region based on the image acquired by the imaging unit.

DESCRIPTION OF THE EMBODIMENTS

First Embodiment

A first embodiment of the present disclosure will be described in detail below.

Figure 1:
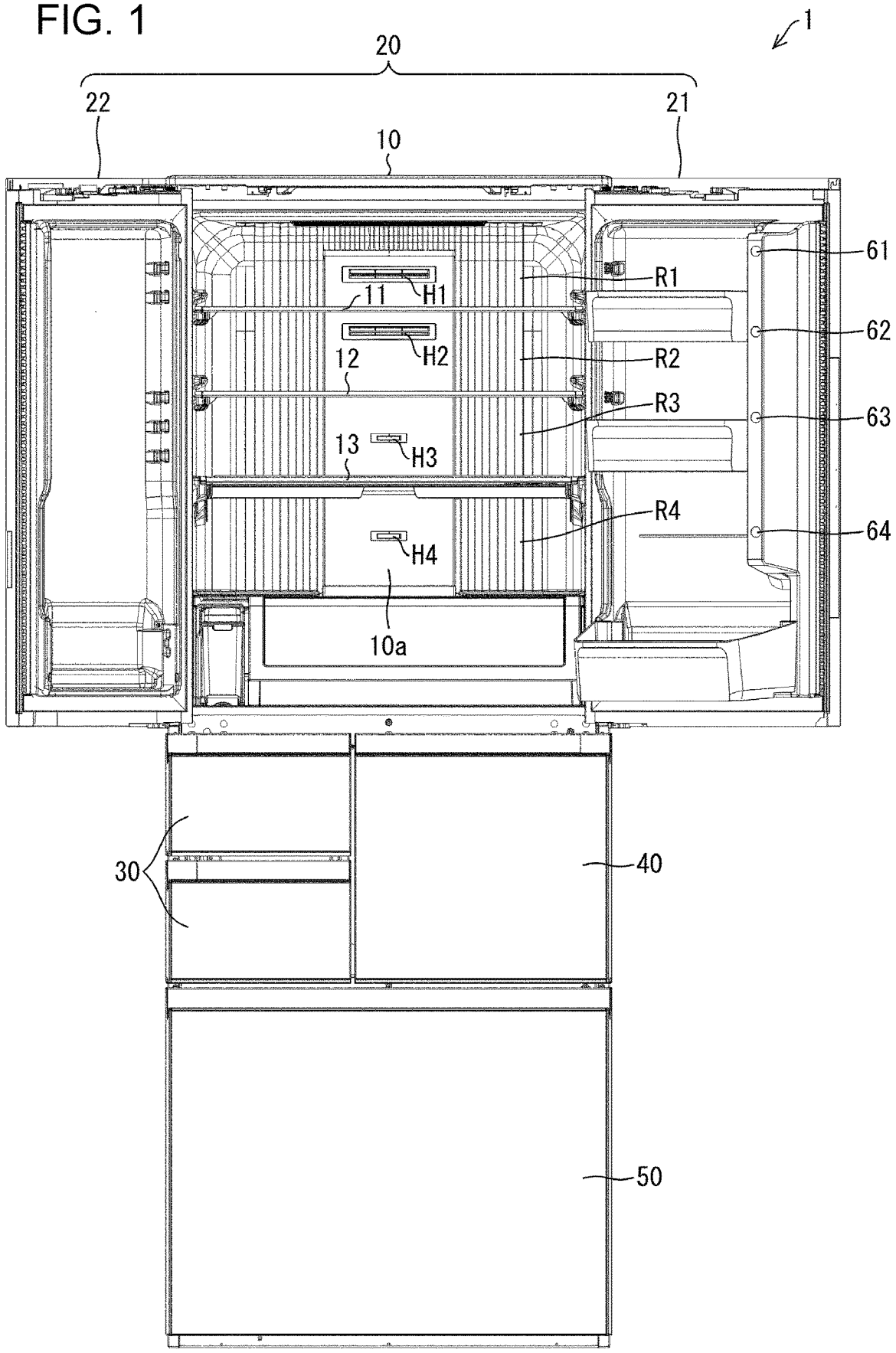
FIG. 1 is a front view illustrating a state where a door of a refrigerator according to a first embodiment is open.
Figure 2:
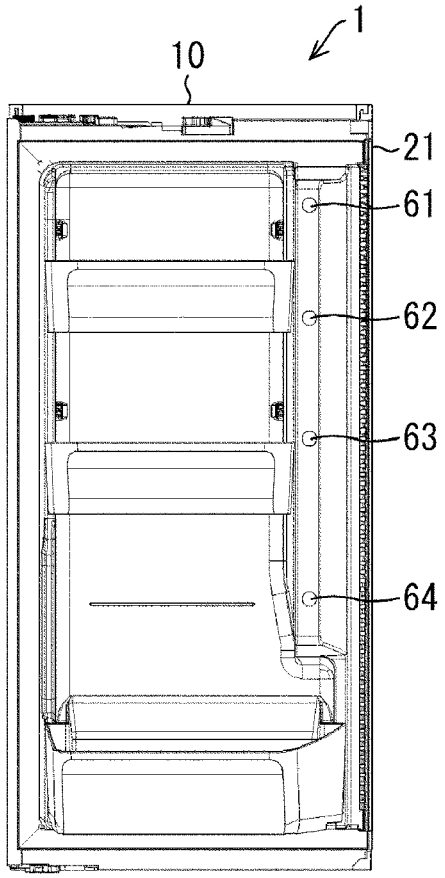
FIG. 2 is a front view illustrating the inner side of a right door of the refrigerator according to the first embodiment.
Figure 3:
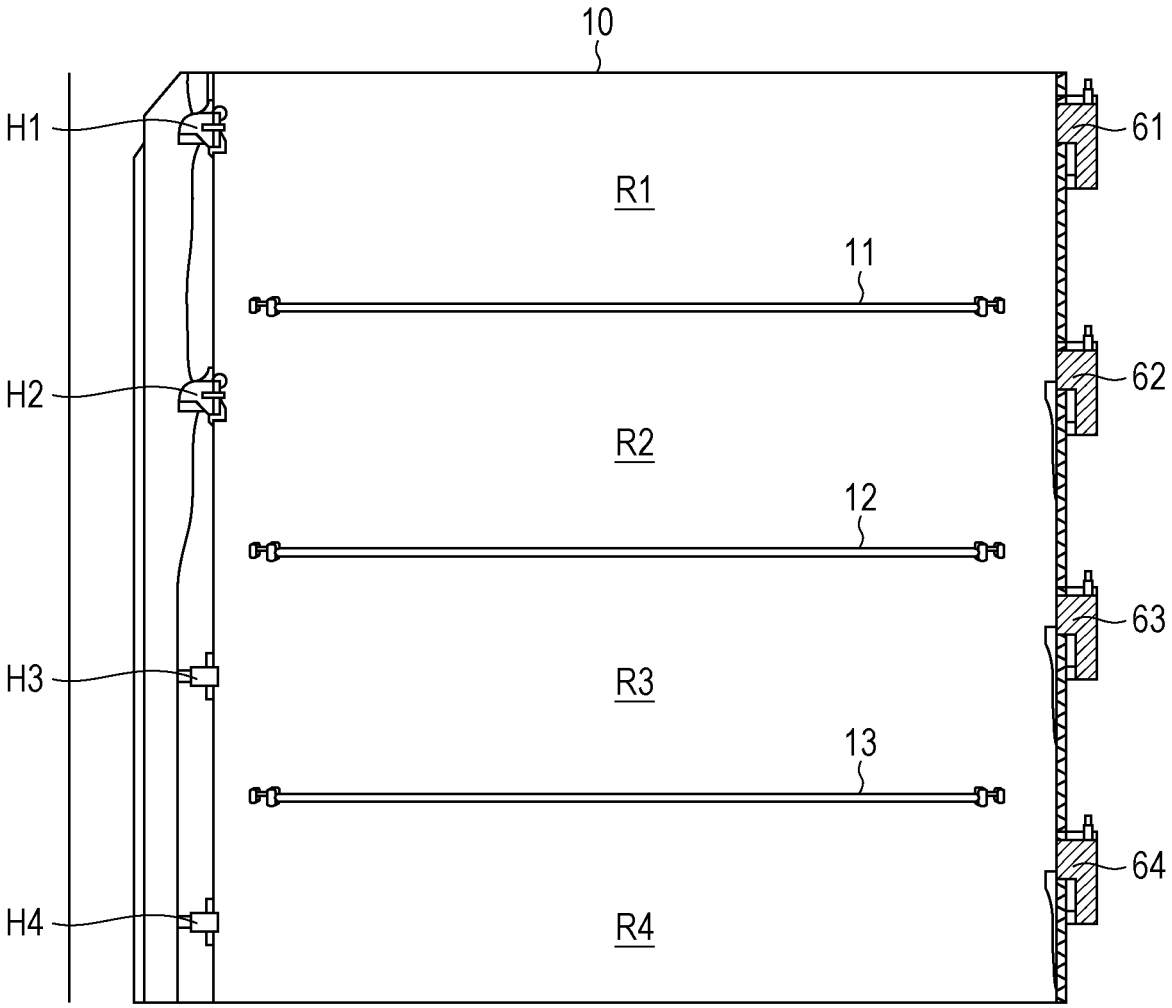
FIG. 3 is a lateral cross-sectional view of a refrigerating compartment included in the refrigerator according to the first embodiment.
Figure 4A:
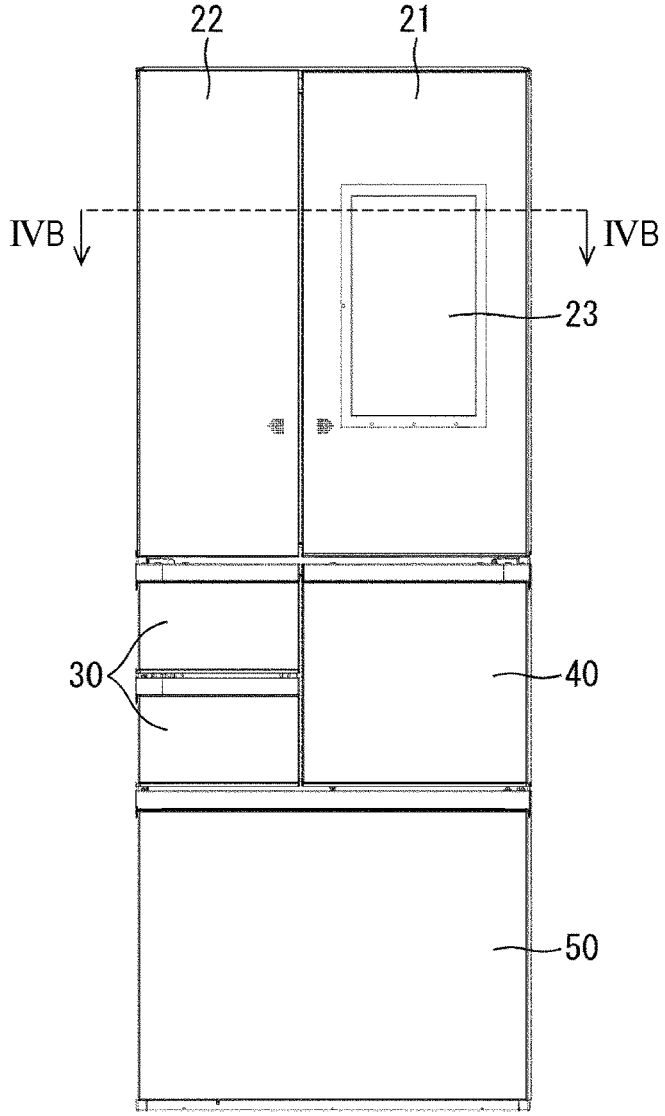
FIG. 4A is a front view illustrating a state where the door of the refrigerator according to the first embodiment is closed.
Figure 4B:
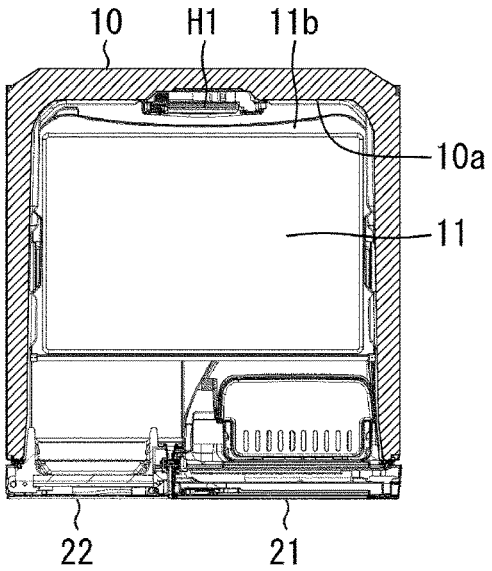
FIG. 4B is a cross-sectional view taken along line IVB-IVB in FIG. 4A.

FIG. 1 is a front view illustrating a state where a door 20 of a refrigerator 1 according to this embodiment is open. FIG. 2 is a front view illustrating the inner side of a right door 21 of the refrigerator 1. FIG. 3 is a lateral cross-sectional view of a refrigerating compartment 10 (storage compartment) included in the refrigerator 1. FIG. 4A is a front view illustrating a state where the door 20 of the refrigerator 1 is closed, and FIG. 4B is a cross-sectional view taken along line IVB-IVB in FIG. 4A.

As shown in FIGS. 1 to 4B, the refrigerator 1 includes the refrigerating compartment 10, the door 20, an ice-making compartment 30, a vegetable compartment 40, and a freezing compartment 50. In FIG. 1, the ice-making compartment 30, the vegetable compartment 40, and the freezing compartment 50 are shown in a state where doors therefor are closed. The refrigerator 1 according to this embodiment does not have to include the ice-making compartment 30, the vegetable compartment 40, and the freezing compartment 50 so long as the refrigerator 1 at least includes the refrigerating compartment 10.

The refrigerating compartment 10 is formed of a thermal insulation box filled with a thermal insulation material. Inside the refrigerating compartment 10 are provided trays 11, 12, and 13 for placing stored objects B thereon (see FIGS. 6A to 6C). The trays 11 to 13 are composed of, for example, transparent glass or plastic.

The interior of the refrigerating compartment 10 is divided into storage regions R1, R2, R3, and R4 in that order from the top by the trays 11, 12, and 13. A rear wall 10*a* of the refrigerating compartment 10 is provided with air outlets H1, H2, H3, and H4, in that order from the top, from which cold air is blown into the refrigerating compartment 10. In detail, the cold air is blown into the storage regions R1 to R4 respectively from the air outlets H1 to H4. A lower end of the refrigerating compartment 10 is provided with a return port (not shown). The return port is used for collecting the cold air blown into the refrigerating compartment 10, so that the cold air is circulated.

The air outlets H1 to H4 have a shape identifiable by a determination unit 71 to be described later. For example, the air outlets H1 to H4 in the rear wall 10*a* are surrounded by a white flat surface, and one air outlets H1 to H4 have a predetermined shape (such as a substantially rectangular shape or a substantially elliptical shape as shown) identifiable by being compared with the surrounding region. Therefore, in images acquired by imaging units 61 to 64 to be described later, the determination unit 71 may readily identify the air outlets H1 to H4. The surrounding region is provided throughout the rear wall 10*a* in the vertical direction thereof.

The door 20 is provided at the front side of the refrigerating compartment 10 in an openable-closable manner. In detail, the door 20 includes the right door 21 and a left door 22 that respectively rotate about rotation shafts provided at the right end and the left end of the refrigerating compartment 10, thereby opening and closing the refrigerating compartment 10. Alternatively, the door 20 may include a single door that opens and closes the refrigerating compartment 10 by rotating about a rotation shaft provided at the right end or the left end of the refrigerating compartment 10.

The inner side of the right door 21 is provided with the imaging units 61, 62, 63, and 64, in that order from the top, for acquiring images of the refrigerating compartment 10. In detail, the imaging units 61 to 64 respectively acquire images of the storage regions R1 to R4. The imaging units 61 to 64 are respectively provided at positions higher than or equal to the heights of the air outlets H1 to H4. Moreover, the imaging units 61 to 64 are respectively provided at positions substantially aligned with the positions of the air outlets H1 to H4 in the width direction of the refrigerating compartment 10. Furthermore, as shown in FIG. 2, the imaging units 61 to 64 are arranged in the vertical direction at the free end of the right door 21, and storage sections, such as door pockets, are not disposed in the vertical direction of the imaging units 61 to 64. Accordingly, a state where stored objects stored in the vertical direction of the imaging units 61 to 64 block the imaging areas of the imaging units 61 to 64 may be suppressed. Furthermore, since a region in front of the imaging units 61 to 64 is a vertically-extending void region, the cold air blown out from the air outlets H1 to H4 may flow downward in the refrigerating compartment 10, so that the circulation of the cold air is not inhibited.

The imaging units 61 to 64 used may be known imaging units of various types, such as charge-coupled device (CCD) cameras or complementary metal oxide semiconductor (CMOS) cameras. Moreover, the imaging units 61 to 64 may include lenses for acquiring images of wide ranges, such as wide-angle lenses or fisheye lenses.

As shown in FIG. 4A, the outer surface of the right door 21 is provided with a display unit 23. The display unit 23 may be, for example, a liquid crystal display. The display unit 23 displays an image for presenting information related to the operation of the refrigerator 1 to a user. As shown in FIG. 4B, the tray 11 is formed of a translucent material surrounded by an opaque edge 11*b*. Although not shown, the trays 12 and 13 have a similar configuration.

In the following description, it is assumed that the trays 11 to 13 are provided in that order from top to bottom. Moreover, it is assumed that the door 20 is located at the front side, and the rear wall 10*a* is located at the rear side.

Figure 5:
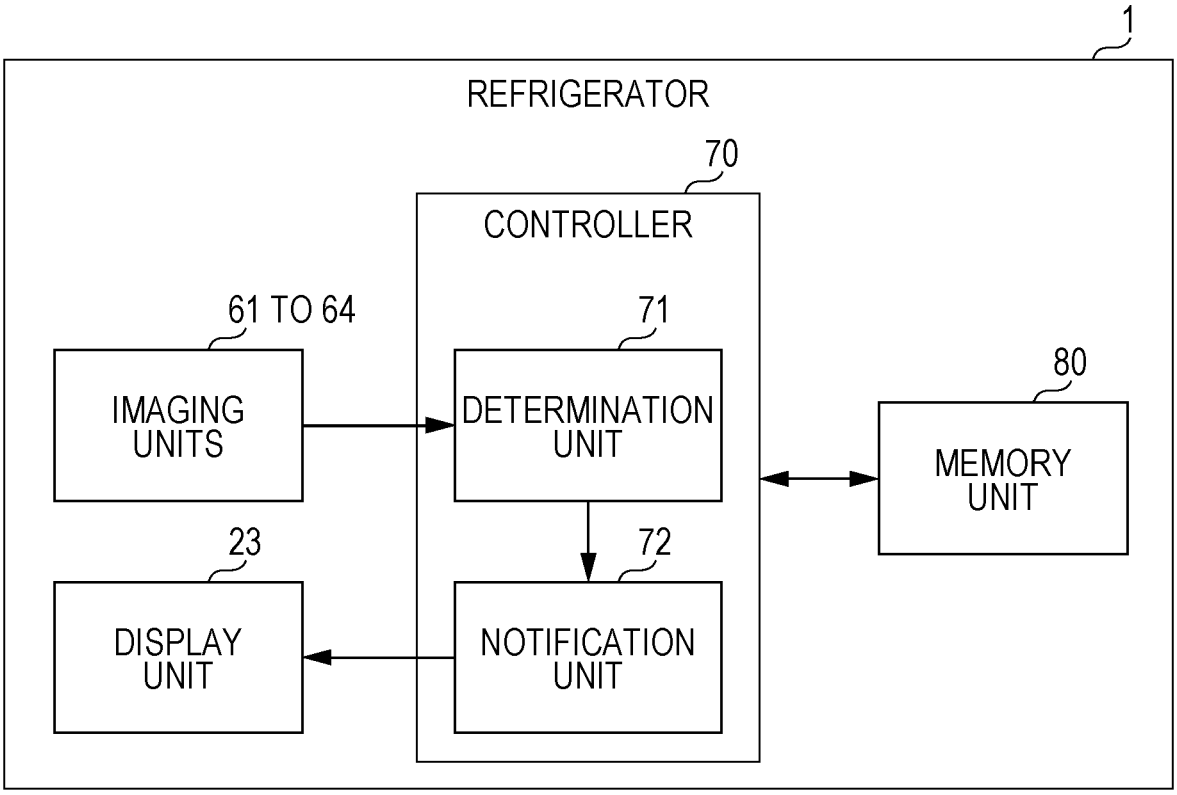
FIG. 5 is a block diagram illustrating the configuration of a relevant part of the refrigerator according to the first embodiment.

FIG. 5 is a block diagram illustrating the configuration of a relevant part of the refrigerator 1. As shown in FIG. 5, the refrigerator 1 includes the imaging units 61 to 64, the display unit 23, a controller 70, and a memory unit 80. The imaging units 61 to 64 and the display unit 23 are as described above.

The controller 70 includes the determination unit 71 and a notification unit 72. The determination unit 71 determines the arrangement states of stored objects stored in the storage regions R1 to R4 based on images acquired by the imaging units 61 to 64. In detail, the determination unit 71 determines whether the cold air blown out from the air outlets H1 to H4 is capable of flowing to the corresponding imaging units 61 to 64. The determination method by the determination unit 71 will be described later.

The notification unit 72 provides a notification to the user in a case where the determination unit 71 determines that a passage (flow passage) along which the cold air blown out from any one of the air outlets H1 to H4 flows forward is blocked. For example, the notification unit 72 may warn the user by displaying a warning image on the display unit 23. If the refrigerator 1 is equipped with a loudspeaker, the notification unit 72 may warn the user by outputting a warning sound from the loudspeaker. Alternatively, if the refrigerator 1 has a network function, the notification unit 72 may warn the user via an external device of the refrigerator 1, such as a user's smartphone.

In the following description, a state where the flow passage of the cold air from any one of the air outlets H1 to H4 is blocked may sometimes be simply stated that "any one of the air outlets H1 to H4 is blocked".

The memory unit 80 stores data used by the controller 70 for controlling the refrigerator 1. The refrigerator 1 does not have to include the memory unit 80 and may alternatively be configured to be communicable with an external memory device.

The determination process performed the determination unit 71 will be described below with reference to the storage region R2 (i.e., target storage region). As a specific example, the determination unit 71 determines whether toe air outlet H2 is blocked based on an image acquired by the imaging unit 62.

Figure 6A:
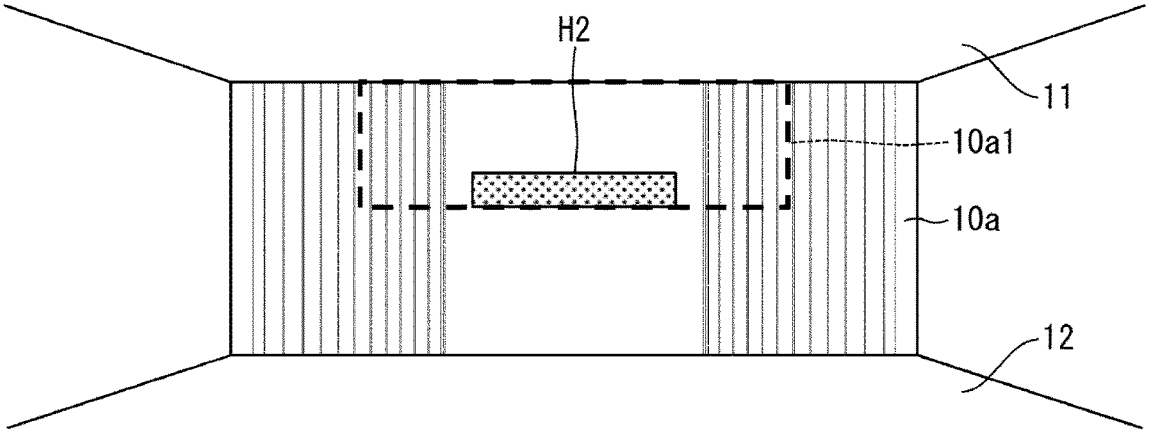
FIG. 6A illustrates an example of an image acquired by an imaging unit.

FIG. 6A illustrates an example of the image acquired by the imaging unit 62. In the example shown in FIG. 6A, the image acquired by the imaging unit 62 includes an image of the entire air outlet H2 in the region of the rear wall 10*a*. In this case, it is clear that the passage along which the cold air from the air outlet H2 flows forward is not blocked.

Supposing that the image acquired by the imaging unit 62 does not include the air outlet H2, it is still conceivable that there is no problem in the flow of the cold air.

Figure 6B:
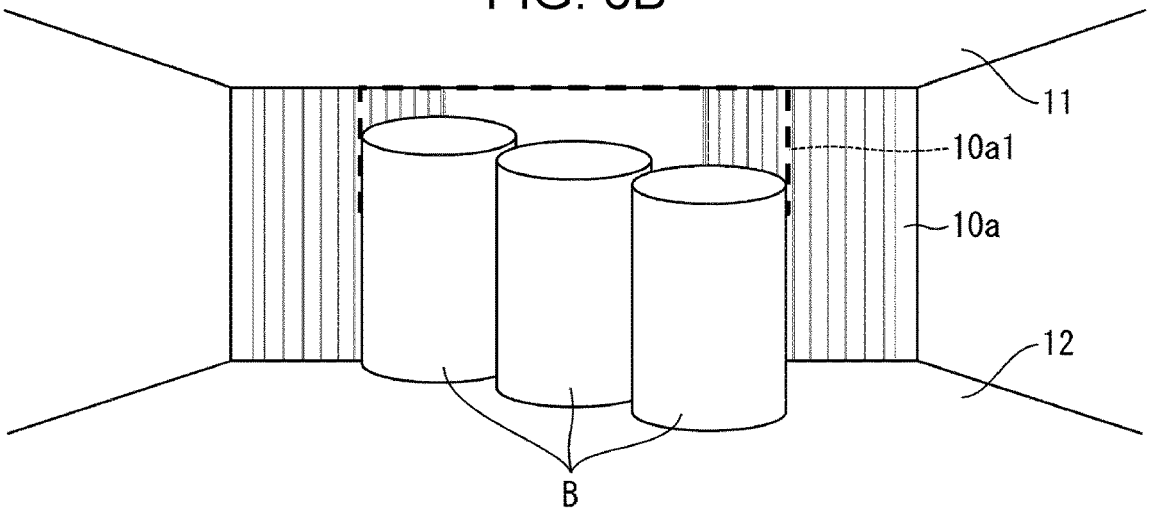
FIG. 6B illustrates another example of the image acquired by the imaging unit.

FIG. 6B illustrates another example of the image acquired by the imaging unit 62. In the example shown in FIG. 6B, the image acquired by the imaging unit 62 does not include the image of the air outlet H2 since the stored objects B exist in front of the air outlet H2. However, the acquired image includes a rear wall 10*a*1 above the lower end of the air outlet H2. In this case, the cold air from the air outlet H2 may reach the door 20, where the imaging unit 62 is set, via an upper section of the storage region R2 (near the lower surface of the tray 11), whereby it is determinable that the flow passage of the cold air is not blocked.

Figure 6C:
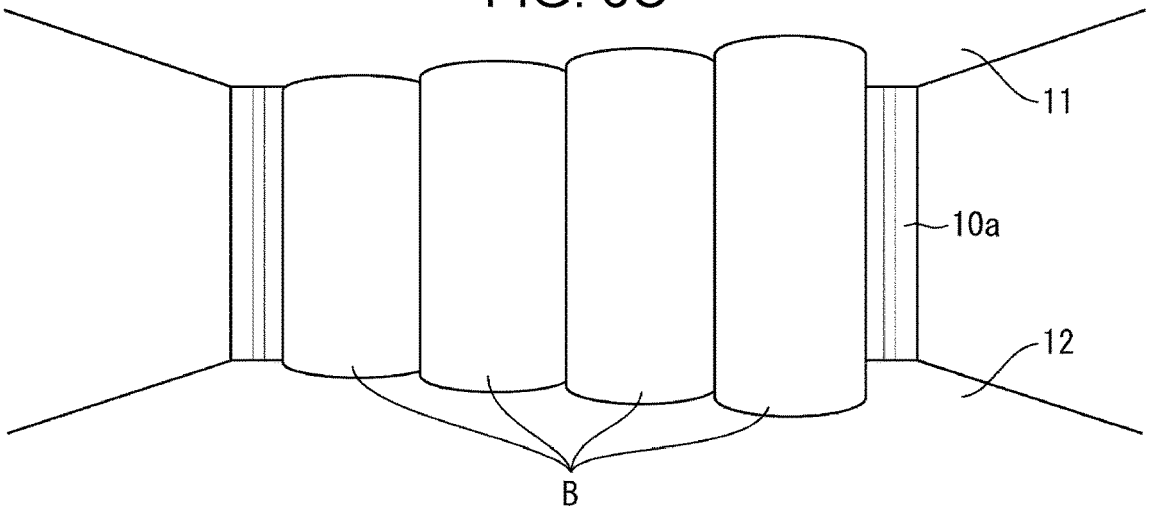
FIG. 6C illustrates another example of the image acquired by the imaging unit.

FIG. 6C illustrates another example of the image acquired by the imaging unit 62. In the example shown in FIG. 6C, the stored objects B are taller than those in the example shown in FIG. 6B. Therefore, neither the air outlet H2 nor the rear wall 10*a*1 is included in the image, but the rear wall 10*a* is included in the image. In this case, the passage along which the cold air from the air outlet H2 flows is not blocked. However, the cold air is not capable of flowing forward linearly, and it is difficult for the flowing cold air to efficiently cool the stored objects B within the storage region R2. Thus, this state has to be treated with attention.

Although the rear wall 10*a*1 above the air outlet H2 at least includes the upper side of the air outlet H2, the rear wall 10*a*1 may extend to a predetermined region closer toward the sidewalls than the upper side of the air outlet H2. Moreover, the rear wall 10*a*1 may extend to predetermined regions at lateral sections of the air outlet H2. The rear wall 10*a*1 has, in a partial region of the rear wall 10*a*, a region where a line connecting the rear wall 10*a*1 and the imaging unit 62 serves as a passage along which the cold air from the air outlet H2 may flow efficiently.

The rear wall 10*a* desirably has a pattern identifiable by the determination unit 71. With the rear well 10*a* having a pattern, the area of the image of the rear wall 10*a* may be readily determined by determining the area of the pattern in each of the images acquired by the imaging units 61 to 64. Since a typical refrigerator has a white inner wall, if a stored object B is white, like the color of tofu, it is difficult to distinguish the rear wall 10*a* and the stored object B from each other and to determine the area of the image of the rear wall 10*a*. In contrast, if the rear wall 10*a* of the refrigerator 1 has a pattern, the rear wall 10*a* and the stored objects B can be distinguished from each other, and the area of the image of the rear wall 10*a* can be determined. The rear wall 10*a* may have a pattern also in the region surrounding the air outlets H1 to H4.

The pattern of the rear wall 10*a* may be, for example, vertical stripes shown in FIG. 1. In this case, the vertical stripes may have uneven pitches in the left-right direction. Furthermore, the rear wall 10*a*1 above the air outlet H2 may have a pattern different from other regions of the rear wall 10*a*.

Figure 7:
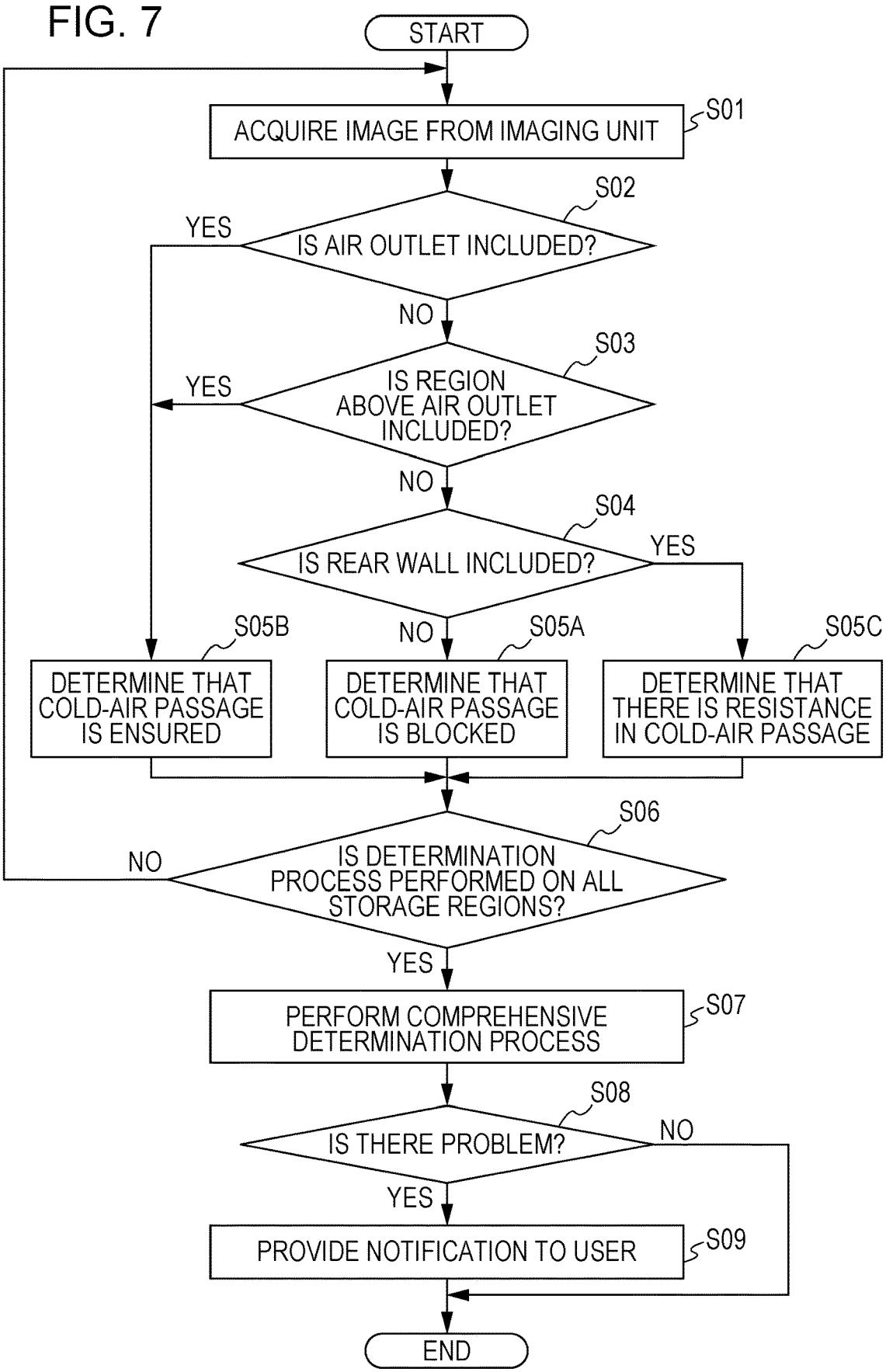
FIG. 7 is a flowchart illustrating a process performed in the refrigerator according to the first embodiment.

FIG. 7 is a flowchart illustrating a process with respect to each of the storage regions R1 to R4 in the refrigerator 1. Although the following description relates to the storage region R2 as an example, the same applies to the storage regions R1, R3, and R4.

In step S01, the determination unit 71 acquires an image from the imaging unit 62. In step S02, the determination unit 71 determines whether the acquired image includes an image of the air outlet H2. If the acquired image does not include an image of the air outlet H2 (NO in step S02), the determination unit 71 determines in step S03 whether the image includes an image of the rear wall 10*a*1 above the air outlet H2. If the image does not include an image of the rear wall 10*a*1 above the air outlet H2 (NO in step S03), the determination unit 71 determines in step S04 whether the image includes an image of the rear wall 10*a*. If the image does not include an image of the rear wall 10*a* (NO in step S04), the determination unit 71 determines in step S05A that the passage of the cold air from the air outlet H2 is blocked (unfavorable determination result).

If the image includes an image of the air outlet H2 (YES in step S02) or if the image includes an image of the rear wall 10*a*1 above the air outlet H2 (YES in step S03), the determination unit 71 determines in step S05B that the passage of the cold air from the air outlet H2 is ensured (favorable determination result). If the image includes an image of the rear wall 10*a* (YES in step S04), the determination unit 71 determines in step S05C that there is resistance in the passage of the cold air from the air outlet H2 (tolerable determination result).

The determination of whether an image of the air outlet H2, rear wall 10*a*1, or rear wall 10*a* is included in steps S02 to S04 may be performed on the basis of, for example, whether the determination unit 71 is capable of recognizing the air outlet H2, rear wall 10*a*1, or rear wall 10*a* by image recognition. Furthermore, the determination may be performed by, for example, recognizing an image of the air outlet H2, rear wall 10*a*1, or rear wall 10*a* by image recognition and determining whether the included image has a predetermined size or larger. The predetermined size may be, for example, a predetermined percentage (e.g., 30%, 50%, or 70%) of the image size in a case where an image of the entire air outlet H2, rear wall 10*a*1, or rear wall 10*a* is acquired. In this case, the predetermined percentage may vary among steps S02 to S04.

The above process is applied to each of the storage regions R1 to R4 in step S06. After the determination is performed with respect to the passage of the cold air from each of the air outlets H1 to H4, it is comprehensively determined in step S07 whether there is a problem with ensuring the passages of the cold air based on the determination results. For example, the determination unit 71 performs the comprehensive determination process as follows.

The determination unit 71 determines that there is no problem if no unfavorable determination result is obtained with respect to any of the storage regions R1 to R4. Even if an unfavorable determination result is obtained with respect to any one of the storage regions R1 to R4, the determination unit 71 still determines that there is no problem if a favorable determination result is obtained with respect to at least one of the remaining storage regions. In contrast, the determination unit 71 determines in step S08 that there is a problem if unfavorable determination results are obtained with respect to at least two of the storage regions R1 to R4 or if an unfavorable determination result is obtained with respect to any one of the storage regions R1 to R4 and tolerable determination results are obtained with respect to the remaining storage regions.

If the comprehensive determination result obtained by the determination unit 71 indicates that there is a problem (YES in step S08), the notification unit 72 provides a notification to the user in step S09. In this case, the notification unit 72 also provides a notification about any of the storage regions R1 to R4 with an unfavorable determination result. The comprehensive determination method described above merely an example. The determination unit may perform the comprehensive determination process in accordance with a different method. For example, if there is an unfavorable determination result with respect to any one of the storage regions R1 to R4, the determination unit 71 may immediately determine that there is a problem.

As mentioned above, the imaging units 61 to 64 are respectively provided at positions higher than or equal to the heights of the air outlets H1 to H4. Therefore, each air outlet may be checked in a bird's eye view in steps S02 and S03, thereby reducing the effect caused by the height of the stored objects B. Specifically, this may suppress a phenomenon where the determination unit 71 outputs a tolerable determination result or an unfavorable determination result due to an inability to acquire images of the air outlets H1 to H4 and the upper rear wall 10*a*1 because of stored objects B disposed near the imaging units 61 to 64, regardless of the fact that the flow passages of the cold air from the air outlets H1 to H4 are ensured at the upper sections of the storage regions R1 to R4.

As described above, in the refrigerator 1, it may be determined whether the flow passages of the cold air from the air outlets H1 to H4 are blocked in the storage regions R1 to R4 based on images acquired by the imaging units 61 to 64, and a notification may be provided to the user if any of the flow passages is blocked.

Furthermore, in addition to being used for observing the air outlets H1 to H4, the imaging units 61 to 64 may be used for managing the stored objects B stored in the refrigerator 1. For example, by transmitting an acquired image of the stored objects stored in the refrigerator 1 to a portable terminal of the user, the user may check the stored objects B from outside the user's home. Therefore, in the refrigerator 1, the imaging units 61 to 64 are used for a plurality of purposes, so that the user may be prompted to ensure the cold-air circulation passage in the refrigerator 1 with a simple configuration.

The refrigerator according to an embodiment of the present disclosure may include a single tray alone or may include four or more trays. In this case, the number of storage regions varies in accordance with the number of trays. The refrigerator according to an embodiment of the present disclosure desirably includes imaging units equal in number to the number of storage regions.

Second Embodiment

A second embodiment of the present disclosure will be described below. For the sake of convenience, components having functions identical to those of the components already described in the above embodiment are given the same reference signs, and descriptions thereof are not repeated. Moreover, for simplification, the refrigerator according to this embodiment is referred to as "refrigerator 1".

Figure 8A:
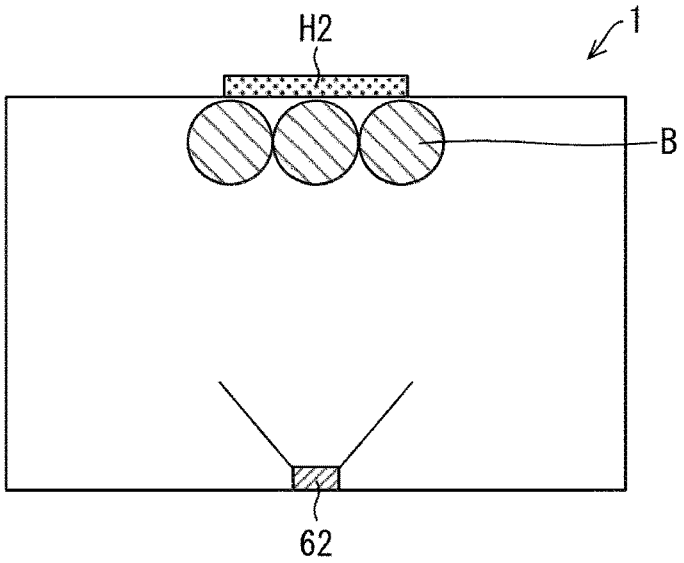
FIGS. 8A to 8C are plan views illustrating examples where an image of an air outlet is not included in the image acquired by the imaging unit.
Figure 8B:
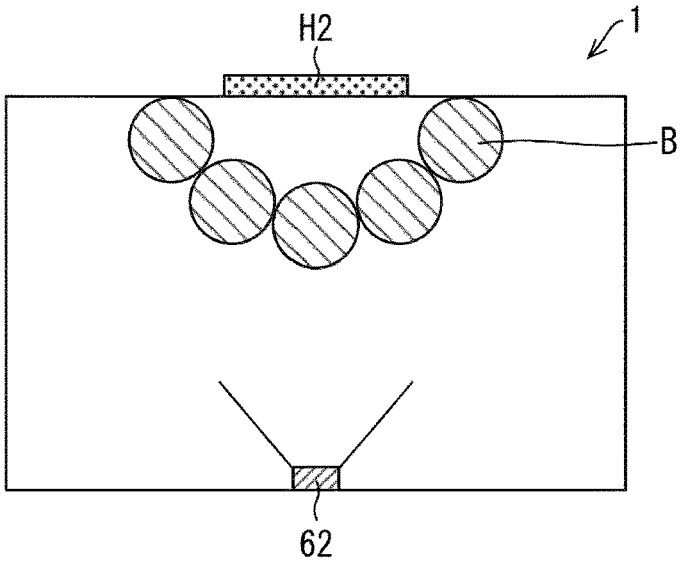
Figure 8C:
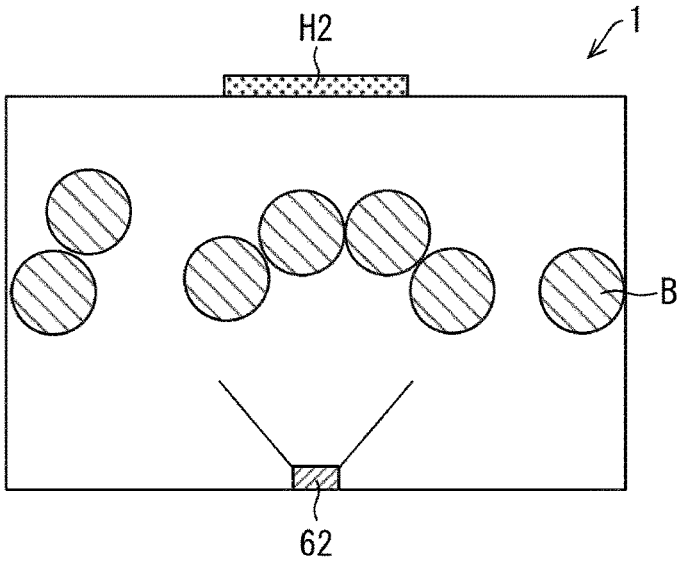

FIGS. 8A to 8C are plan views illustrating examples where an image of the air outlet H2 is not included in an image acquired by the imaging unit 62. In the example shown in FIG. 8A, stored objects B are disposed immediately near the air outlet H2. In this case, it may be regarded that the air outlet H2 is blocked. In the example shown in FIG. 8B, stored objects B are disposed surrounding the air outlet H2 at a position slightly away from the air outlet H2. In this case, it is regarded that the air outlet H2 is not blocked, although this depends on the height of the stored objects B. In the example shown in FIG. 8C, stored objects are disposed near an intermediate point between the air outlet H2 and the imaging unit 62 and at opposite sides of the intermediate point. In this case, the air outlet H2 is not blocked since there is sufficient space between the air outlet H2 and the stored objects B. However, in the storage region R of the refrigerator 1 according to the first embodiment, if the stored objects B are tall to an extent that an image of the rear wall 10*a*1 is not acquirable, it is difficult to determine the states of FIGS. 8A to 8C from the image acquired by the imaging unit 62.

Figure 9:
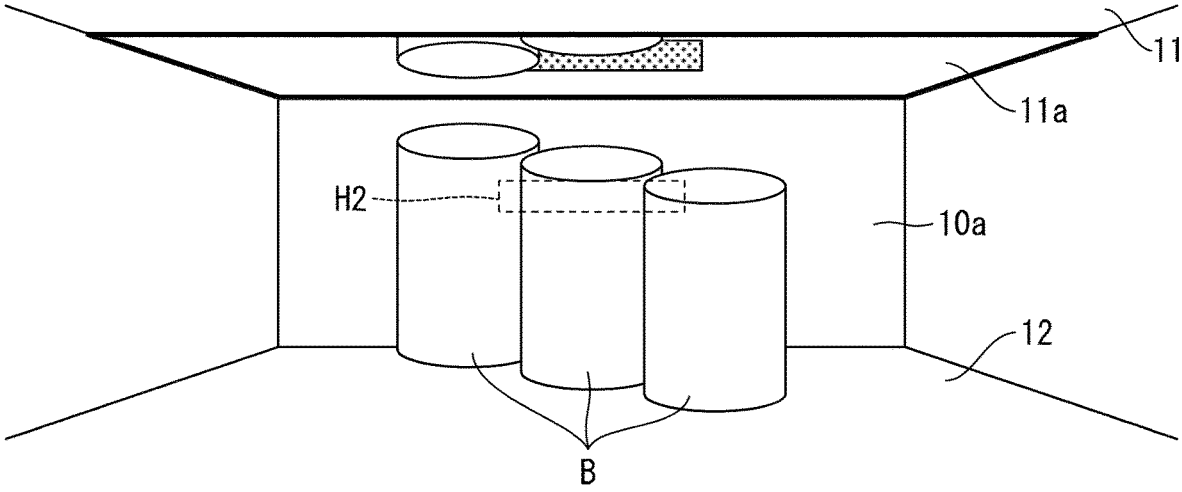
FIG. 9 illustrates an example of an image acquired by the imaging unit in a refrigerator according to a second embodiment.
Figure 10:
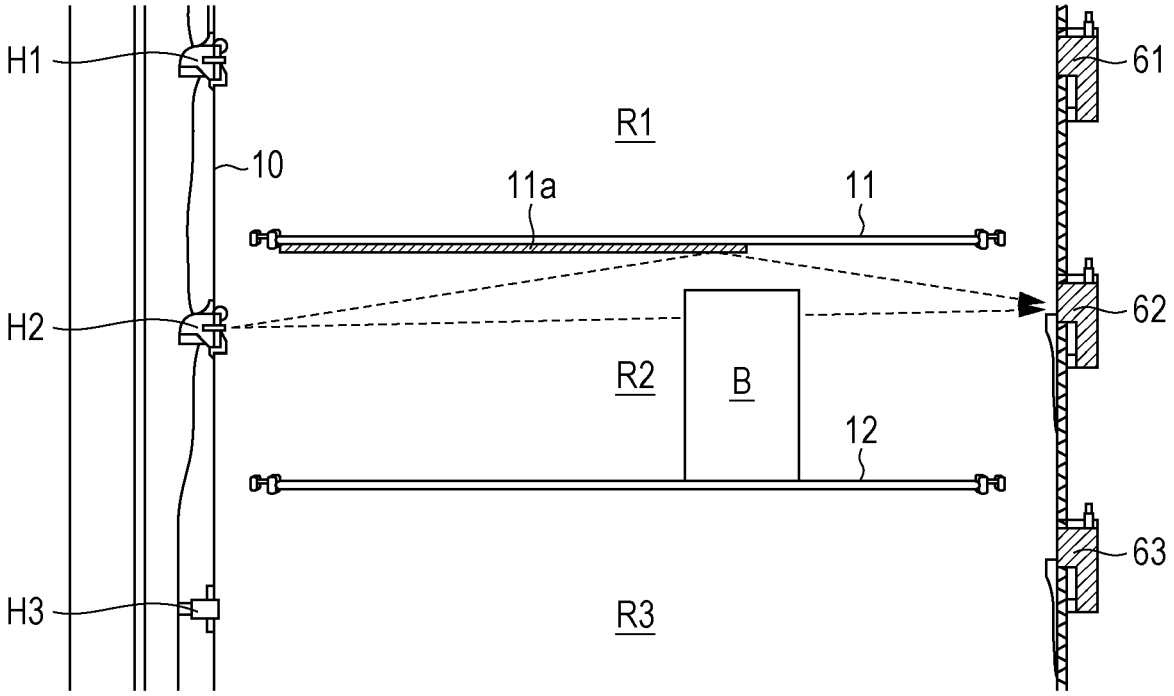
FIG. 10 illustrates components of light entering the imaging unit in the refrigerator according to the second embodiment.

FIG. 9 illustrates an example of an image acquired by the imaging unit in the refrigerator 1. FIG. 10 illustrates components of light entering the imaging unit 62 in the refrigerator 1. As shown in FIGS. 9 and 10, the refrigerator 1 includes a mirror 11*a* that is provided on the upper surface of the storage region R2 and that reflects the upper side of the air outlet H2 relative to the imaging unit 62. Therefore, as shown in FIGS. 9 and 10, according to the refrigerator 1, even when the image acquired by the imaging unit 62 does not include a directly-acquired image of the air outlet H2, the determination unit 71 may determine whether the air outlet H2 is blocked in accordance with an image of the air outlet H2 reflected on the mirror 11*a*. Likewise, the refrigerator 1 may include a mirror on the lower surface of each of the trays 12 and 13.

Figure 11:
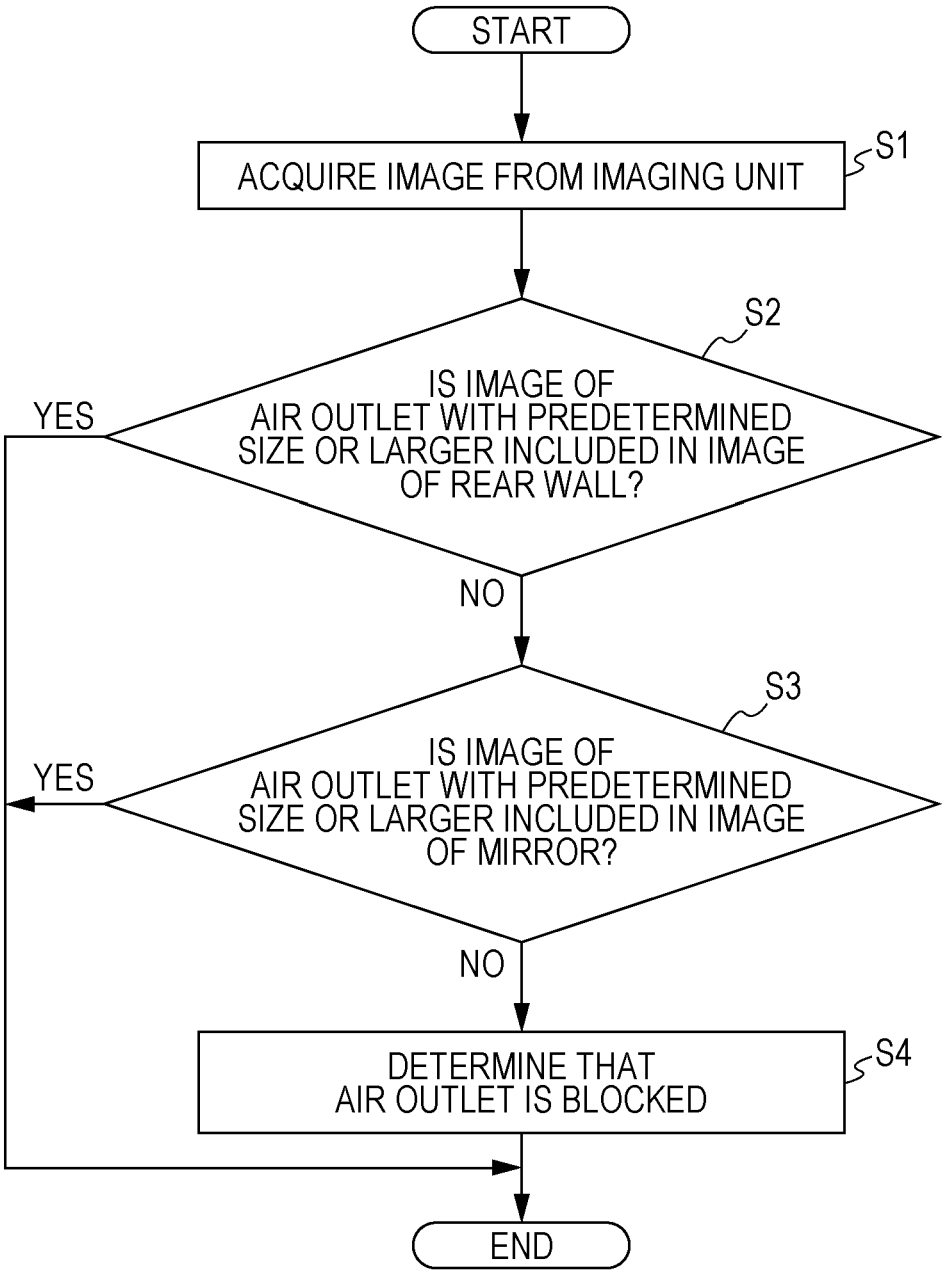
FIG. 11 is a flowchart illustrating a process performed in the refrigerator according to the second embodiment.

FIG. 11 is a flowchart illustrating a process performed in the refrigerator 1 according to this embodiment.

In step S1, the determination unit 71 acquires an image from the imaging unit 62. In step S2, the determination unit 71 determines whether the acquired image includes image of the air outlet H2 with a predetermined size or larger in the region of the rear wall 10*a*. If the region of the rear wall 10*a* does not include an image of the air outlet H2 with the predetermined size or larger (NO in step S2), the determination unit 71 determines in step S3 whether the acquired image includes an image of the air outlet H2 with the predetermined size or larger in the region of the mirror 11*a*. If the region of the mirror 11*a* does not include an image of the air outlet H2 with the predetermined size or larger (NO in step S3), the determination unit 71 determines in step S4 that the air outlet H2 is blocked.

If the region of the rear wall 10*a* includes an image of the air outlet H2 with the predetermined size or larger (YES in step S2) or if the region of the mirror 11*a* includes an image of the air outlet H2 with the predetermined size or larger (YES in step S3), the determination unit 71 determines that the air outlet H2 is not blocked and ends the process.

Similarly to the above example, the determination unit 71 may determine whether the air outlets H1, H3, and H4 are blocked based on images acquired by the imaging units 61, 63, and 64. Subsequently, a comprehensive determination process is performed similarly to the first embodiment.

Similar to the refrigerator 1 according to the first embodiment, the refrigerator 1 according to this embodiment may perform the comprehensive determination process after obtaining a favorable, tolerable, or unfavorable determination result with respect to each of the storage regions R1 to R4. On the other hand, similar to the refrigerator 1 according to this embodiment, the refrigerator 1 according to the first embodiment may provide a notification to the user when determining that the flow passage of cold air from the corresponding one of the air outlets H1 to H4 in any one of the storage regions R1 to R4 is blocked.

Because the positions or the imaging units 61 to 64 are fixed in the refrigerator 1, the region corresponding to the rear wall 10*a* and the region corresponding to the mirror 11*a* are also substantially fixed in the images acquired by the imaging units 61 to 64. Therefore, these regions may be specified in advance and may be stored in the memory unit 80. An image of the air outlet H2 in each of the region corresponding to the rear wall 10*a* and the region corresponding to the mirror 11*a* in the images acquired by the imaging units 61 to 64 may be specified by image recognition.

Accordingly, the refrigerator 1 according to this embodiment includes the mirror 11*a* on the lower surface of the tray 11 so that the air outlets H1 to H4 are more readily observable, as compared with the refrigerator according to the first embodiment.

In the state shown in FIG. 8C, the stored objects B are separated by gaps. Therefore, even when images of the air outlets H1 to H4 are not shown in an acquired image, it is conceivable that an image of the rear wall 10*a* is shown. If the acquired image shows the image of the rear wall 10*a*, a passage along which cold air flows from the rear wall 10*a* is formed between any of the imaging units 61 to 64 having acquired the image of the rear wall 10*a*. As shown in FIGS. 1 and 2, if the region in front of the imaging units 61 to 64 is a vertically-extending void region, the cold air flowing toward any of the imaging units 61 to 64 from the rear wall 10*a* via the aforementioned passage may flow to the return port provided at the lower end of the refrigerating compartment 10 via the void region. Therefore, similar to the refrigerator 1 according to the first embodiment, the determination unit 71 may further execute a step for determining whether the air outlets H1 to H4 are blocked based on whether the acquired image includes an image of the rear wall 10*a*.

In detail, the determination unit 71 determines that the air outlets H1 to H4 are not blocked if the area of the image of the rear wall 10*a* in the acquired image is larger than or equal to a predetermined value. In contrast, if the area of the image of the rear wall 10*a* in the acquired image is not larger than or equal to the predetermined value, the determination unit 71 determines that the air outlets H1 to H4 are blocked. This determination process may be performed between, for example, steps S3 and S4 described above.

Furthermore, the determination unit 71 may execute step S3 in addition to the process in the first embodiment. In detail, for example, the determination unit 71 may take into account a result of a process corresponding to step S3 to at least one of steps S02, S03, and S04 in FIG. 7. Since an image acquired via the mirror 11*a* corresponds to a bird's-eye-view image from a position higher than the image acquired in the first embodiment, the effect caused by the height of the stored objects B may be further reduced.

Furthermore, with an image acquired via the mirror 11*a*, the distance from the air outlet H2 or the rear wall 10*a* to each stored object B is more readily determinable. Therefore, the determination unit 71 may measure the distance based on the acquired image and may perform a process for obtaining a tolerable determination result or an unfavorable determination result in the first embodiment if the measured distance is smaller than or equal to a predetermined distance. In this case, if the determination unit 71 determines that the distance between the air outlet H2 and a stored object B placed in front of the air outlet H2 is smaller than or equal to the predetermined distance, the determination unit 71 determines that a cold-air flow passage is not sufficiently ensured.

The predetermined distance is set in advance for each storage region in accordance with the amount of cold air blown out from the corresponding air outlet, the flow speed, and the size and shape of the storage region. For example, if there is a stored object within 2 cm from the air outlet, an unfavorable determination result may be obtained, and if there is a stored object in a range between 2 cm and 4 cm from the air outlet, a tolerable determination result may be obtained. The predetermined distance may be settable and changeable by the user. Furthermore, such a distance-based determination process may be performed in other embodiments to be described below.

Third Embodiment

A third embodiment of the present disclosure will be described below. For the sake of convenience, components having functions identical to those of the components already described in the above embodiments are given the same reference signs, and descriptions thereof not repeated.

Figure 12:
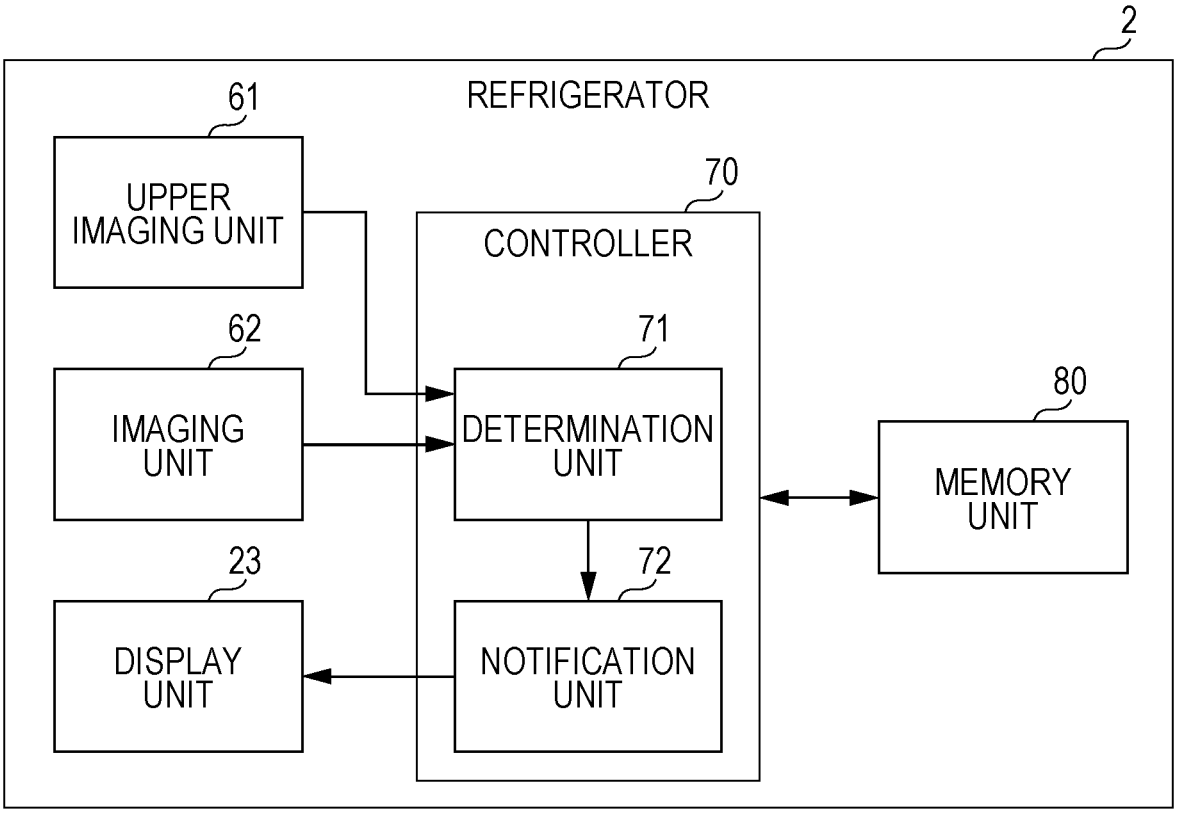
FIG. 12 a block diagram illustrating the configuration of a relevant part of a refrigerator according to a third embodiment.

FIG. 12 is a block diagram illustrating the configuration of a relevant part of a refrigerator 2 according to this embodiment. The refrigerator 2 actually has a configuration similar to that of the refrigerator 1. For the sake of convenience, among the imaging units 61 to 64, only the imaging unit 62 is shown as an imaging unit in the block diagram shown in FIG. 12, and the imaging unit 61 is indicated as an "upper imaging unit 61" for clarifying that the imaging unit 61 is an imaging unit located above the imaging unit 62. The upper imaging unit 61 is provided above the imaging unit 62 at the inner side of the door 20 and acquires an image inside the refrigerating compartment 10 from the door 20. More specifically, the upper imaging unit 61 is capable of acquiring an image of the storage region R2 (target storage region) from the storage region R1 (upper storage region) located above the storage region R2. Furthermore, in the refrigerator 2, the determination unit 71 determines whether the air outlet 2 in the storage region R2 is blocked based on an image acquired by the imaging unit 62 and an image acquired by the upper imaging unit 61.

Figure 13:
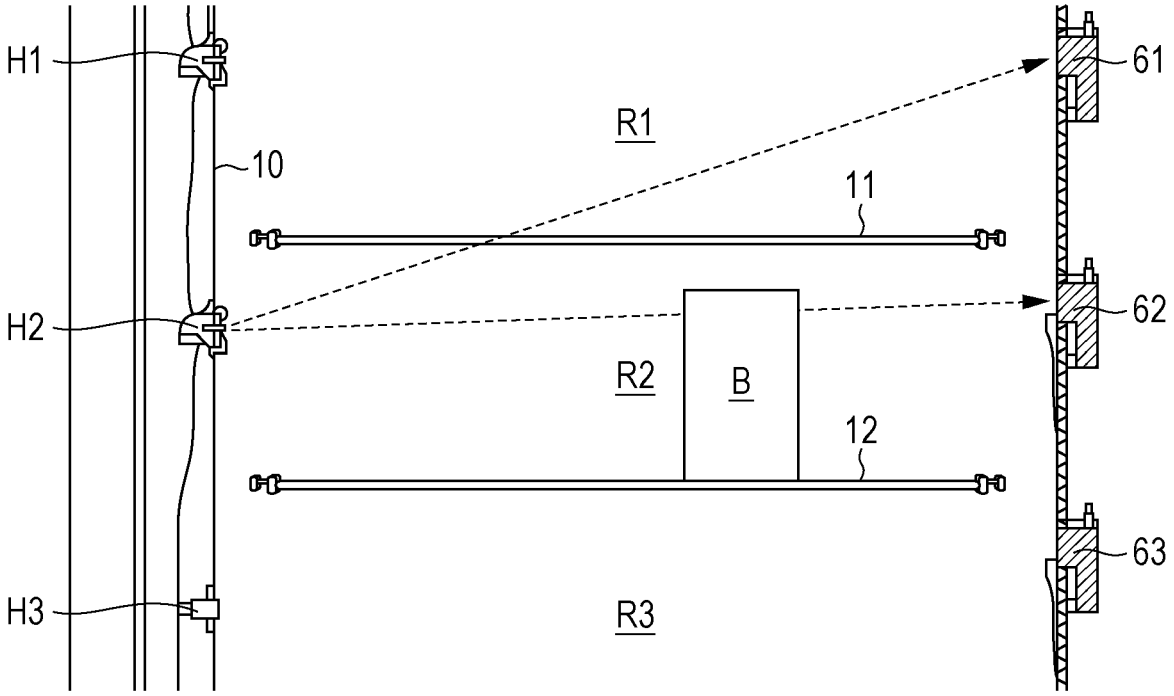
FIG. 13 illustrates optical paths of components of light that form images acquired by the imaging unit and an upper imaging unit in the refrigerator according to the third embodiment.

FIG. 13 illustrates optical paths of components of light that form the images acquired by the imaging unit 62 and the upper imaging unit 61 in the refrigerator 2. As shown in FIG. 13, the upper imaging unit 61 is provided above the imaging unit 62 and is capable of acquiring an image of the storage region R2 from the storage region R1 (upper storage region). Therefore, although an image of the air outlet H2 included in the image acquired by the imaging unit 62 is small, the determination unit 71 may determine that the air outlet H2 is not blocked based on the image acquired by the upper imaging unit 61 if the air outlet H2 not actually blocked by the stored objects B. Accordingly, the imaging unit 62 and the upper imaging unit 61 acquire images of the storage region R2 so that the state of the passage of cold air from the air outlet H2 is more readily observable.

Figure 14:
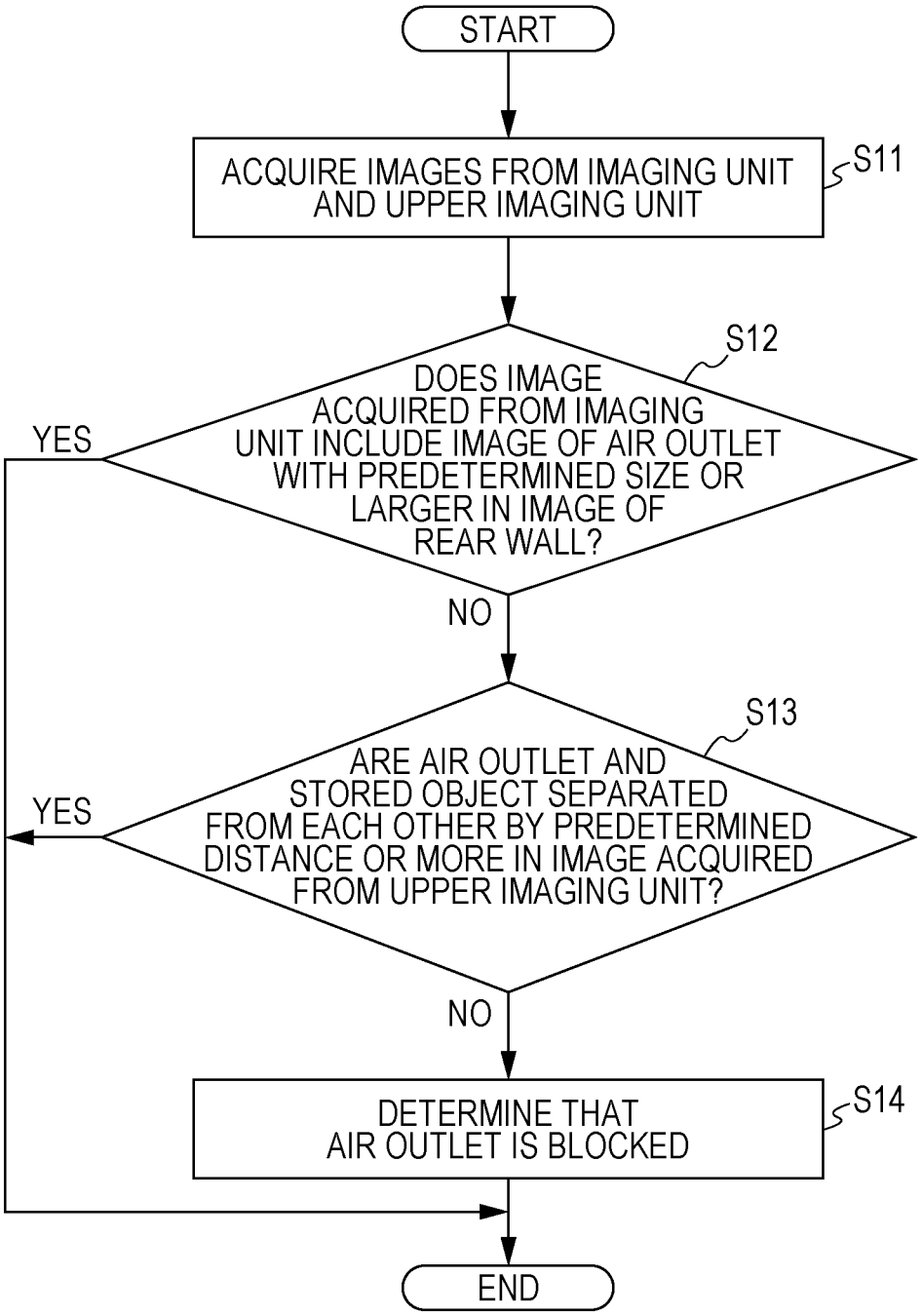
FIG. 14 is a flowchart illustrating a process performed in the refrigerator according to the third embodiment.

FIG. 14 is a flowchart illustrating a process performed in the refrigerator 2.

In step S11, the determination unit 71 acquires images from the imaging unit 62 and the upper imaging unit 61. In step S12, the determination unit 71 determines whether the image acquired from the imaging unit 62 includes an image of the air outlet H2 with a predetermined size or larger in the region of the rear wall 10*a*. If the image acquired from the imaging unit 62 does not include an image of the air outlet H2 with the predetermined size or larger (NO in step S12), the determination unit 71 determines in step S13 whether the distance between the air outlet H2 and a stored object B placed in front of the air outlet H2 is larger than or equal to a predetermined distance in the image acquired from the upper imaging unit 61. A method used for determining the distance may include, for example, determining whether the image acquired from the upper imaging unit 61 includes an image of the air outlet H2 with the predetermined size or larger or measuring the distance by recognizing the air outlet H2 and the stored object B from the acquired image. If the distance between the air outlet H2 and the stored object B is not equal to or larger than the predetermined distance (NO in step S13), the determination unit 71 determines in step S14 that the air outlet H2 is blocked.

In contrast, if the image acquired from the imaging unit 62 includes an image of the air outlet H2 with the predetermined size or larger (YES in step S12) or if it is determined that the distance between the air outlet H2 and the stored object B is equal to or larger than the predetermined distance based on the image acquired from the upper imaging unit 61 (YES in step S13), the determination unit 71 determines that the air outlet H2 is not blocked and ends the process. The predetermined size and the predetermined distance are the same as those described in the first and second embodiments.

The determination unit 71 may determine whether the air outlets H3 and H4 are blocked by similarly performing the process shown FIG. 14. When performing the determination process with respect to the air outlet H3, the determination unit 71 performs above-described determination process based on images acquired by the imaging unit 63 and the imaging unit 62. When performing the determination process with respect to the air outlet H4, the determination unit 71 performs the above-described determination process based on images acquired by the imaging unit 64 and the imaging unit 63. Subsequently, the determination unit 71 performs a comprehensive determination process similarly to the first embodiment.

However, with regard to the air outlet H1, none of the imaging units 61 to 64 is usable as an upper imaging unit. Therefore, for example, the determination unit 71 may determine whether the air outlet H1 is blocked based only on an image acquired by the imaging unit 61, as in the first embodiment.

Accordingly, in the refrigerator 2, it may be determined whether each of the air outlets H1 to H4 is blocked based on a plurality of images among images acquired by the imaging units 61 to 64, and the user may be warned if any of the air outlets is blocked. Therefore, in the refrigerator 2, the determination unit 71 determines whether the air outlets H1 to H4 are blocked with high accuracy, so that the user can be prompted to ensure a cold-air circulation passage within the refrigerator 2 more accurately.

The process performed in the refrigerator 2 may be applied to the refrigerator 1 according to the first or second embodiment described above. For example, the determination unit 71 may perform the determination process in step S13 after the above-described step S04 or S3 in the refrigerator 1.

Fourth Embodiment

A fourth embodiment of the present disclosure will be described below.

Figure 15:
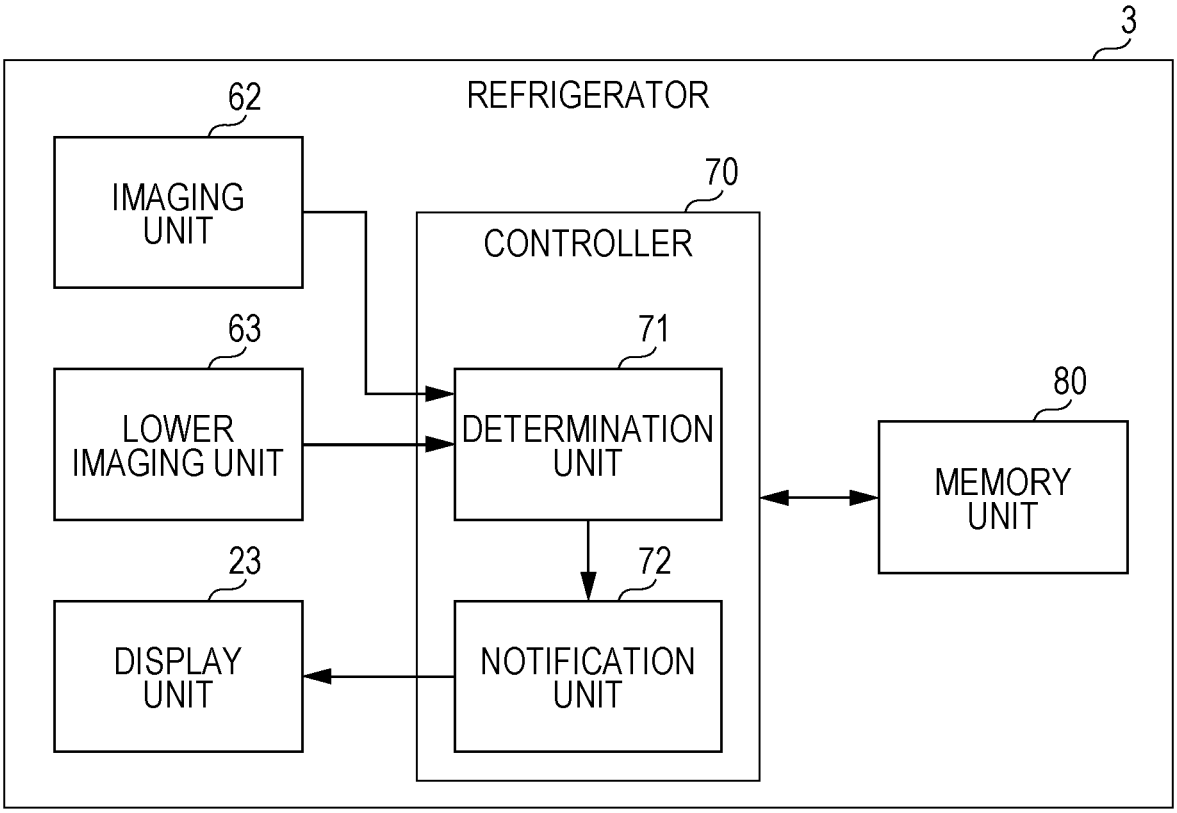
FIG. 15 a block diagram illustrating the configuration of a relevant part of a refrigerator according to a fourth embodiment.

FIG. 15 is a block diagram illustrating the configuration of a relevant part of a refrigerator according to this embodiment. Similar to the refrigerator 1, the refrigerator 3 includes the imaging units 61 to 64. For the sake of convenience, among the imaging units 61 to 64, only the imaging unfit 62 is shown as an imaging unit in the block diagram shown in FIG. 15, and the imaging unit 63 is indicated as an "lower imaging unit 63" for clarifying that the imaging unit 63 is an imaging unit located below the imaging unit 62. The lower imaging unit 63 is provided below the imaging unit 62 at the inner side of the door 20 and acquires an image inside the refrigerating compartment 10 from the door 20. More specifically, the lower imaging unit 63 is capable of acquiring an image of the storage region R2 (target storage region) from the storage region R3 (lower storage region) located below the storage region R2 via the tray 12. Furthermore, in the refrigerator 3, the determination unit 71 determines whether the air outlet H2 in the storage region R2 is blocked based on an image acquired by the imaging unit 62 and an image acquired by the lower imaging unit 63.

Figure 16:
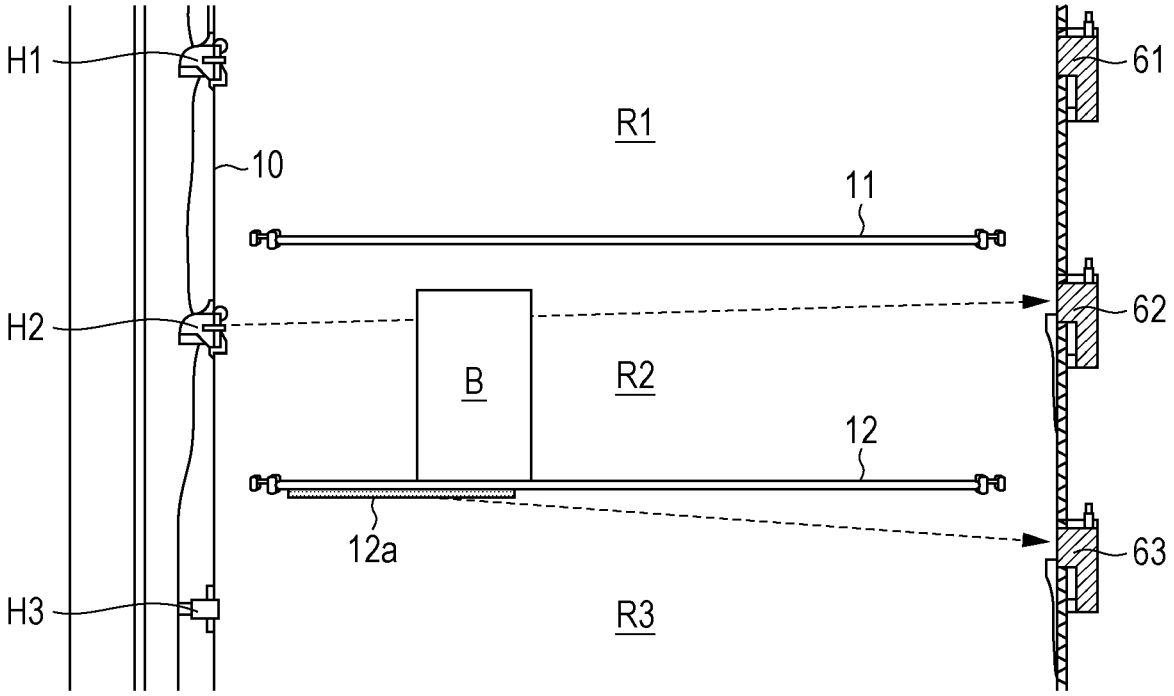
FIG. 16 illustrates components of light entering the imaging unit and a lower imaging unit in the refrigerator according to the fourth embodiment.

FIG. 16 illustrates components of light that enter the imaging unit 62 and the imaging unit 63 in the refrigerator 3. Similar to the other embodiments, the imaging unit 62 receives light from the storage region R2, including light from the air outlet H2, as shown in FIG. 16. On the other hand, as shown in FIG. 16, the imaging unit 63 receives light from the storage region R3, including light from the lower surface of the tray 12.

Figure 17A:
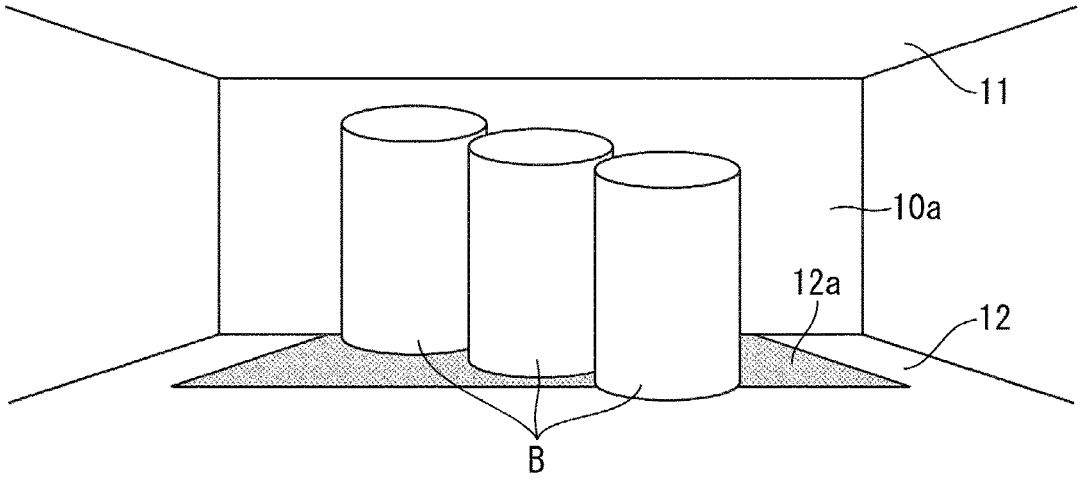
FIG. 17A illustrates an example of an image acquired by the imaging unit in the refrigerator according to the fourth embodiment.
Figure 17B:
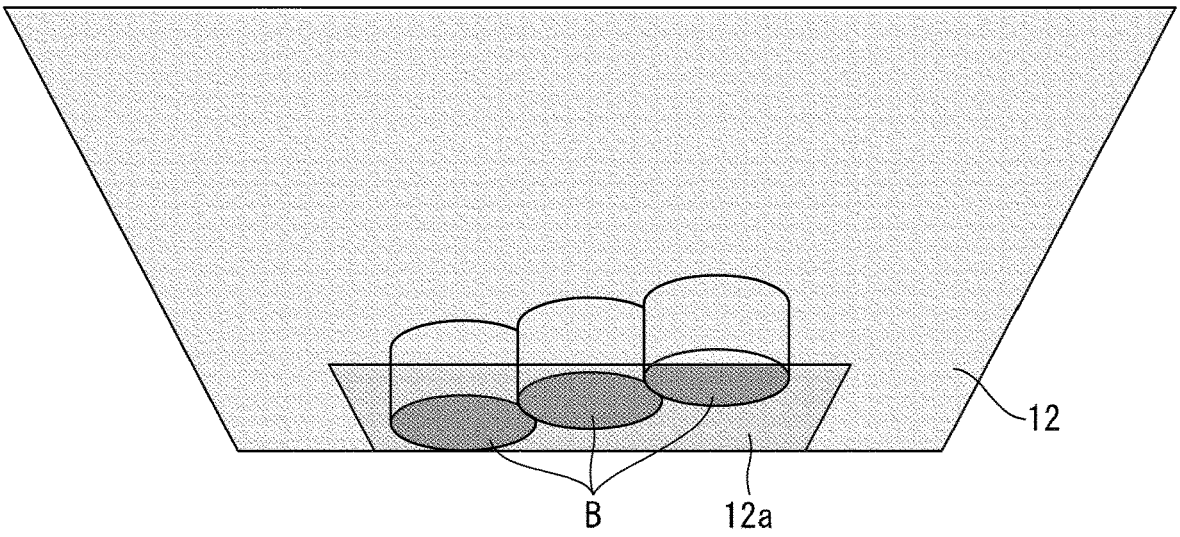
FIG. 17B illustrates an example of an image acquired by the lower imaging unit in the refrigerator according to the fourth embodiment.

FIG. 17A illustrates an example of an image acquired by the imaging unit 62 in the refrigerator 3. FIG. 17B illustrates an example of an image acquired by the lower imaging unit 63 in the refrigerator 3. As shown in FIGS. 16, 17A, and 17B, in the refrigerator 3, the tray 12 that defines the lower end of the storage region R2 is provided with an optical region 12*a* near the air outlet H2. The optical region 12*a* has optical characteristics that direct a component of light traveling from the storage region R2 and transmitted through the tray 12 toward the lower imaging unit 63. Thus, as shown in FIG. 17B, the lower imaging unit 63 is capable of acquiring an image of stored objects B placed in the optical region 12*a*. Since the optical region 12*a* extends to an edge at the rear wall 10*a* side of the tray 2, the lower imaging unit 63 is capable of acquiring an image of the stored object B located closest to the air outlet H2. However, in the refrigerator 3, the tray 12 does not have to be provided with the optical region 12*a*.

In this embodiment, the determination unit 71 determines whether the air outlet H2 is blocked based on the image acquired by the lower imaging unit 63 in addition to the image acquired by the imaging unit 62. In a case where the determination process is performed based on the image acquired by the lower imaging unit 63, determination unit 71 specifically determines whether the air outlet H2 is blocked based on the position of the image of the stored objects B in a region corresponding to the optical region 12*a* in the image acquired by the lower imaging unit 63. More specifically, if the image of the stored objects B in the region corresponding to the optical region 12*a* is not separated from the rear wall 10*a* having the air outlet H2 by a predetermined distance (e.g., 2 cm) or more, the determination unit 71 determines that the air outlet H2 is blocked.

Figure 18:
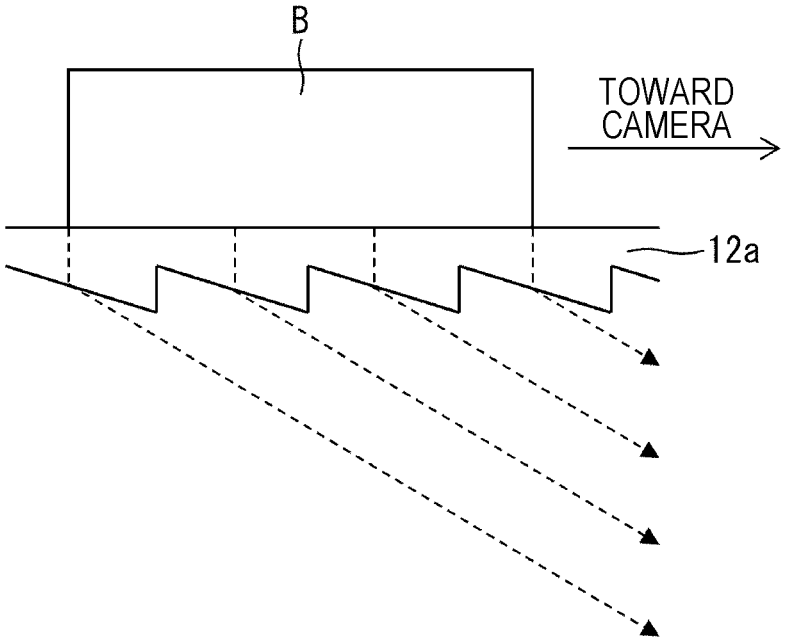
FIG. 18 is a cross-sectional view illustrating an example of the structure of an optical region.

FIG. 18 is a cross-sectional view illustrating an example of the structure of the optical region 12*a*. For example, as shown in FIG. 18, the optical region 12*a* may be substantially serrated at the lower side of the cross section. In detail, the lower surface of the optical region 12*a* may have a structure in which vertical surfaces and inclined surfaces whose front side is lower than the rear side are alternately repeated. In this case, a component of light traveling downward from a stored object B placed in the optical region 12*a* is refracted in the optical region 12*a* and is directed toward the lower imaging unit 63.

Furthermore, the optical region 12*a* may be, for example, a surface processed to scatter light. In this case, the processed surface may have, for example, a semi-translucent appearance. Moreover, the optical region 12*a* may be given an anti-reflection treatment so that light transmitted through the tray 12 is readily observable. Since the lower imaging unit 63 is similar to the other imaging units in having a height larger than or equal to the height of the air outlet H3, the distance between the tray 12 and the lower imaging unit 63 in the height direction is reduced, and the output angle of light output toward the lower imaging unit 63 from the lower surface of the tray 12 is increased (i.e., becomes substantially parallel to the lower surface of the tray 12). Since total reflection occurs at the lower surface of the tray 12 when the output angle is larger than or equal to the optimum angle, the light transmitted through the tray 12 does not reach the lower imaging unit 63. In other words, lower imaging unit 63 becomes incapable of acquiring an image of the stored objects B placed on the tray 12 in the storage region R2. In this embodiment, the tray 12 is provided with the optical region 12*a* so that the light transmitted through the tray 12 reaches the lower imaging unit 63.

Furthermore, as described above, the tray 12 is surrounded by the opaque edge 11*b* (see FIG. 4B). The edge 11*b* at the rear wall 10*a* side is located in front of the air outlet H2. The determination unit 71 may recognize the edge 11*b* and calculate the distance from the edge 11*b* to the stored objects B in the optical region 12*a*.

Figure 19:
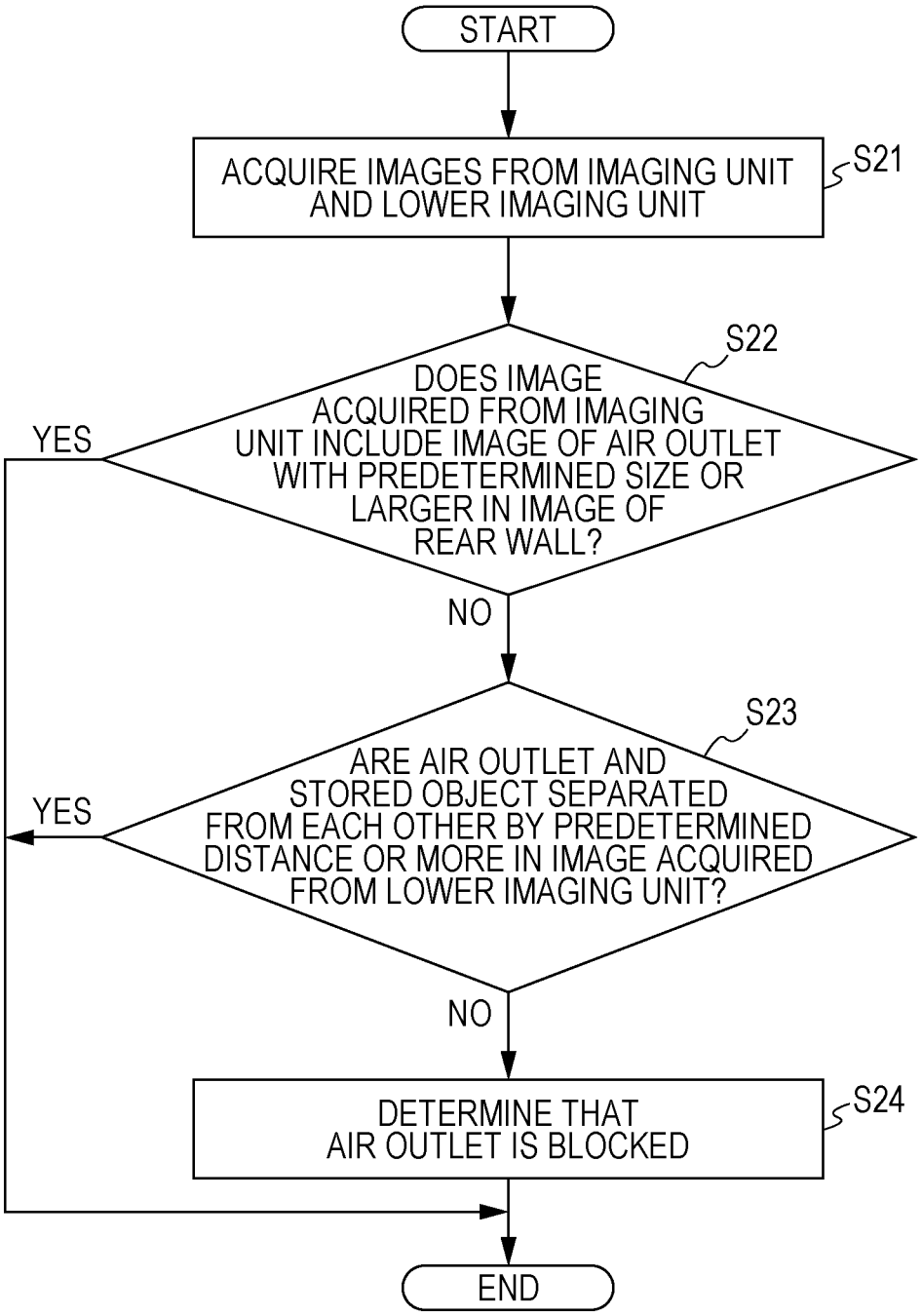
FIG. 19 is a flowchart illustrating a process performed in the refrigerator according to the fourth embodiment.

FIG. 19 is a flowchart illustrating a process performed in the refrigerator 3.

In step S21, the determination unit 71 acquires images from the imaging unit 62 and the lower imaging unit 63. In step S22, the determination unit 71 determines whether the image acquired from the imaging unit 62 includes an image of the air outlet H2 with a predetermined size or larger in the region of the rear wall 10*a*. If the image acquired from the imaging unit 62 does not include an image of the air outlet H2 with the predetermined size or larger (NO in step S22), the determination unit 71 determines in step S23 whether the distance between the air outlet H2 and a stored object B placed in front of the air outlet H2 is larger than or equal to a predetermined distance in the image acquired from the lower imaging unit 63. If the distance between the air outlet H2 and the stored object B is not equal to or larger than the predetermined distance in the image acquired from the lower imaging unit 63 (NO in step S23), the determination unit 71 determines in step S24 that the air outlet H2 is blocked.

In contrast, if the image acquired from the imaging unit 62 includes an image of the air outlet H2 with the predetermined size or larger (YES in step S22) or if it is determined that the distance between the air outlet H2 and the stored object B is equal to or larger than the predetermined distance based on the image acquired from the lower imaging unit 63 (YES in step S23), the determination unit 71 determines that the air outlet H2 is not blocked and ends the process. The predetermined size and the predetermined distance are the same as those described in the first and second embodiments.

The determination unit 71 may determine whether the cold-air flow passages are blocked with respect to the air outlets H1 and H3 by similarly performing the process shown in FIG. 19. When performing the determination process with respect to the air outlet H1, the determination unit 71 performs the above-described determination process based on images acquired by the imaging unit 61 and the imaging unit 62 (lower imaging unit). When performing the determination process with respect to the air outlet H3, the determination unit 71 performs the above-described determination process based on images acquired by the imaging unit 63 and the imaging unit 64.

However, with regard to the air outlet H4, none of the imaging units 61 to 64 is usable as a lower imaging unit. Therefore, for example, the determination unit 71 may determine whether the air outlet H4 is blocked based only on an image acquired by the imaging unit 64, as in the first embodiment.

The process performed in the refrigerator 3 may be applied to the refrigerator 1 or 2 described above. For example, the determination unit 71 may perform the determination process in step S23 after the above-described step S04 or S3 in the refrigerator 1 or after the above-described step S13 in the refrigerator 2.

Fifth Embodiment

A fifth embodiment of the present disclosure will be described below.

A refrigerator according to this embodiment has a configuration substantially identical to of the refrigerator 3 described above. Therefore, in the following description, the refrigerator according to this embodiment will also be referred to as "refrigerator 3".

Figure 20A:
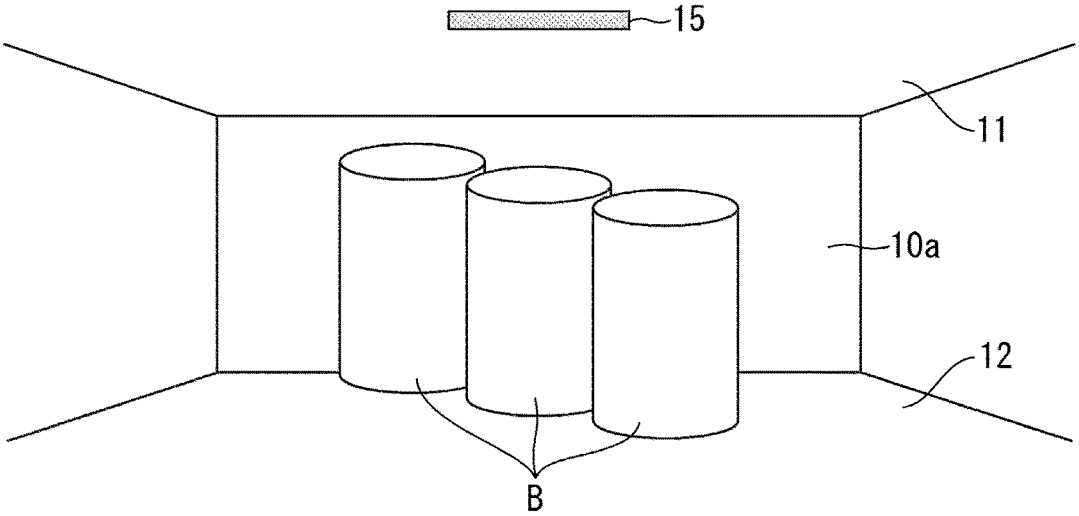
FIG. 20A illustrates an example of an image acquired by the imaging unit in a refrigerator according to a fifth embodiment.
Figure 20B:
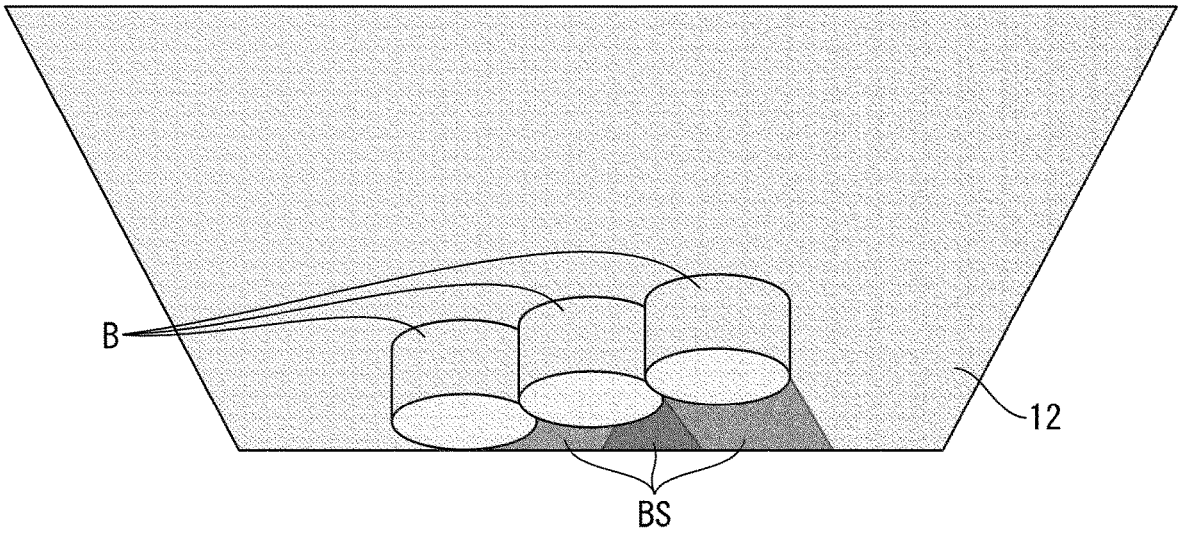
FIG. 20B illustrates an example of an image acquired by the lower imaging unit in the refrigerator according to the fifth embodiment.

FIG. 20A illustrates an example of an image acquired by the imaging unit 62 in the refrigerator according to this embodiment. FIG. 20E illustrates an example of an image acquired by the lower imaging unit 63 in the refrigerator 3 according to this embodiment. The refrigerator 3 according to this embodiment includes a light radiator 15 in addition to the components of the refrigerator 3 according to the third embodiment. As shown in FIG. 20A, the light radiator 15 is disposed so as to radiate light onto the storage region R2 from above. Therefore, as shown in FIG. 20B, the lower imaging unit 63 acquires as image of shadows BS of stored objects B formed on the tray 12, which defines the lower end of the storage region R2, in accordance with the light from the light radiator 15. In this embodiment, the determination unit 71 performs the determination process by using the area of the image of the shadows BS in the image acquired by the lower imaging unit 63.

Figure 21:
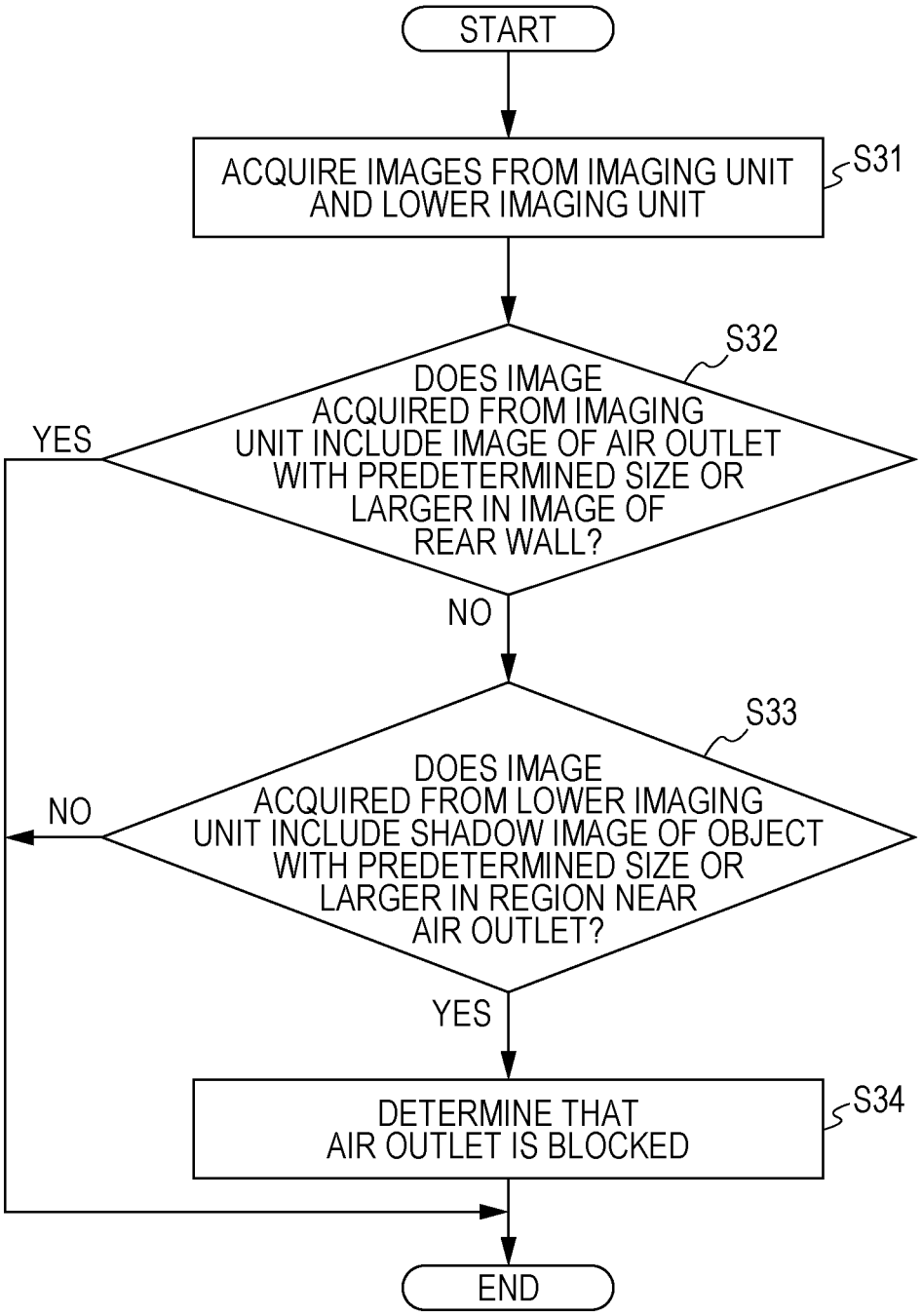
FIG. 21 is a flowchart illustrating a process performed in the refrigerator according to the fifth embodiment.

FIG. 21 is a flowchart illustrating a process performed in the refrigerator 3 according to this embodiment.

In step S31, the determination unit 71 acquires images from the imaging unit 62 and the lower imaging unit 63. In step S32, the determination unit 71 determines whether the image acquired from the imaging unit 62 includes an image of the air outlet H2 with a predetermined size or larger in the region of the rear wall 10*a*. If the image acquired from the imaging unit 62 does not include an image of the air outlet H2 with the predetermined size or larger (NO in step S32), the determination unit 71 determines in step S33 whether the image acquired from the lower imaging unit 63 includes an image of a shadow BS of a stored object B with a predetermined size or larger in the region of the tray 12 near the air outlet H2. If the image acquired from the lower imaging unit 63 includes a shadow image of the stored object B with the predetermined size or larger (YES in step S33), the determination unit 71 determines in step S34 that the air outlet H2 is blocked.

In contrast, if the image acquired from the imaging unit 62 includes an image of the air outlet H2 with the predetermined size or larger (YES in step S32) or if the image acquired from the lower imaging unit 63 does not include a shadow image of the stored object B with the predetermined size or larger (NO in step S33), the determination unit 71 determines that the air outlet H2 is not blocked and ends the process.

In this embodiment, the determination unit 71 may determine whether the image acquired from the lower imaging unit 63 includes an image including the image of the stored object B with the predetermined size or larger in addition to the image of the shadow BS of the stored object B. As another alternative, the determination unit 71 may determine whether the image with the predetermined size or larger is included by using the image of the stored object B alone.

Furthermore, in this embodiment, the determination unit 71 may determine whether the air outlet H2 and the stored object B placed in front of the air outlet H2 are separated from each other by a predetermined distance or more based on the image of the shadow BS of the stored object B in the image acquired from the lower imaging unit 63. In this case, since the position of the shadow BS of the stored object B varies depending on the light from the light radiator 15 and the height of the stored object B, it is desirable that the distance criterion for determining that the air outlet H2 is blocked be different from the determination criterion in the fourth embodiment.

In a refrigerator according to an embodiment of the present disclosure, the third or fourth embodiment may be combined with the second embodiment. Specifically, for example, the determination unit 71 may determine whether the air outlet H1 is blocked based on images acquired from the imaging unit 61 and the imaging unit 62. Furthermore, the determination unit 71 may determine whether the air outlet H2 is blocked based on images acquired from the imaging unit 62, the imaging unit 61, and the imaging unit 63. Moreover, the determination unit 71 may determine whether the air outlet H3 is blocked based on images acquired from the imaging unit 63, the imaging unit 62, and the imaging unit 64. Furthermore, the determination unit 71 may determine whether the air outlet H4 is blocked based on images acquired from the imaging unit 64 and the imaging unit 63.

Specifically, in a refrigerator according to an embodiment of the present disclosure, the determination unit 71 may determine whether the air outlet H2 is blocked based on images acquired by the imaging unit 62 and the imaging unit 61 or 63. Moreover, the determination unit 71 may determine whether the air outlet H3 (i.e., lower air outlet) is blocked based on images acquired by the imaging units 62 and 63. Furthermore, the determination unit 71 may determine whether the air outlet H1 (i.e., upper air outlet) is blocked based on images acquired by the imaging units 62 and 61. Accordingly, the determination unit 71 may determine whether a plurality of air outlets are blocked based on images acquired from a plurality of directions.

The process performed in the refrigerator 3 according to this embodiment may be applied to the refrigerators 1 to 3 described above. For example, the determination unit 71 may determine the determination process in step S33 after the above-described step S04 or S3 in the refrigerator 1, the above-described step S13 in the refrigerator 2, or the above-described step S23 in the refrigerator 3 according to the fourth embodiment.

Example Realized by Software

The control blocks (i.e., the determination unit 71 and the notification unit 72) in each of the refrigerators 1 to 3 may be realized by a logical circuit (hardware) formed in an integrated circuit (IC) chip or by software.

In the latter case, each of the refrigerators 1 to 3 includes a computer that executes a command for a software program that realizes the functions. This computer includes, for example, at least one processor (controller) and at least one computer-readable storage medium having the program stored therein. In the computer, the processor loads the program from the storage medium and executes the program, so that the objective of the present disclosure is achieved. The processor used nay be, for example, a central processing unit (CPU). The storage medium used may be, for example, a nonvolatile physical medium, such as a read-only memory (ROM), a tape, a disk, a card, semiconductor memory, or a programmable logical circuit. A random access memory (RAM) that develops the program may be further included. Moreover, the program may be supplied to the computer via a freely-chosen transmission medium (such as a communication network or a broadcast wave) capable of transmitting the program. An embodiment of the present disclosure may be realized in the form of a data signal incorporated in a carrier wave, in which the program is realized by electronical transmission.

CONCLUSION

A refrigerator according to a first aspect of the present disclosure includes a storage compartment, a door, an air outlet, an imaging unit, and a determination unit. The storage compartment has a storage region that stores a stored object. The door opens and closes the storage compartment. The air outlet is provided in a rear wall of the storage region and blows cold air into the storage region. The imaging unit is provided at an inner side of the door at a position higher than or equal to a height of the air outlet and acquires an image of the storage region from the door. The determination unit determines an arrangement state of the stored object stored in the storage region based on the image acquired by the imaging unit.

According to the above configuration, the imaging unit that acquires the image of the refrigerating compartment provided at the inner side of the door is provided at the position higher than or equal to the height of the air outlet. The determination unit determines the arrangement state of the stored object stored in the storage region based on the image acquired by the imaging unit. Furthermore, the imaging unit can also be used for managing the stored object in the refrigerator. Therefore, a refrigerator that may prompt a user to ensure a cold-air circulation passage in the refrigerator can be realized with a simple configuration.

According to a second aspect of the present disclosure, in refrigerator according to the first aspect, the air outlet may have a shape identifiable by the determination unit.

According to the above configuration, the determination unit can identify the air outlet in the image acquired by the imaging unit.

According to a third aspect of the present disclosure, the refrigerator according to the first or second aspect, the rear wall may be provided with a predetermined pattern identifiable by the determination unit.

According to the above aspect, the determination unit can identify the rear wall in the image acquired by the imaging unit.

According to a fourth aspect of the present disclosure, the refrigerator according to any one of the first to third aspects may further include a mirror that is provided on an upper surface of the storage region and that reflects an upper side of the air outlet relative to the imaging unit.

According to the above configuration, the state of the passage of cold air from the air outlet is more readily observable with the mirror.

According to a fifth aspect of the present disclosure, the refrigerator according to any one of the first to fourth aspects may further include a lower imaging unit that is provided below the imaging unit at the inner side of the door and that acquires an image of the storage compartment from the door. The storage compartment may be divided into a plurality of storage regions by a plurality of translucent trays on which stored objects are placed. The imaging unit may acquire an image of a target storage region included in the storage regions and being a storage region including the air outlet. The lower imaging unit may be capable of acquiring an image of the target storage region via the trays from a lower storage region included in the storage regions and located below the target storage region.

According to the above configuration, the refrigerator includes the imaging unit and the lower imaging unit provided below the imaging unit, and acquires images of the target storage region including the air outlet from a plurality of directions. By acquiring images from the plurality or directions, the state of the passage of cold air from the air outlet is more readily observable.

According to a sixth aspect of the present disclosure, in the refrigerator according to the fifth aspect, the tray that defines a lower end of the target storage region may be provided with an optical region near the air outlet, the optical region having optical characteristics that direct a component of light traveling from the target storage region and transmitted through the tray toward the lower imaging unit.

According to the above configuration, the light from near the air outlet can travel toward the lower imaging unit more readily. Therefore, the state near the air outlet is more readily observable by using the lower imaging unit.

According to a seventh aspect of the present disclosure, the refrigerator according to the fifth aspect may further include a light radiator that radiates light onto the target storage region from above. The lower imaging unit may acquire an image of a shadow formed by the light on the tray that defines a lower end of the target storage region.

According to the above configuration, a shadow forms on the tray in accordance with the light radiated from the light radiator. The lower imaging unit acquires an image of the shadow so that the state near the air outlet is more readily observable.

According to an eight aspect of the present disclosure, in the refrigerator according to any one of the first to seventh aspects, the determination unit may determine whether an image of at least one of the air outlet and a predetermined region of the rear wall is acquired. The refrigerator may further include a notification unit that provides a not to a user if the determination unit determines that the image of the air outlet or the predetermined region of the rear wall is not acquired.

According to the above configuration, the determination unit determines whether the image of at least one of the air outlet and the predetermined region of the rear wall is acquired. Moreover, if the image of neither the air outlet nor the predetermined region of the rear wall is acquired, the notification unit provides a notification to the user. Therefore, the user can be warned in a case where the flow passage of cold air from the air outlet is blocked.

According to a ninth aspect of the present disclosure, in the refrigerator according to any one of the fifth to seventh aspects, the determination unit may determine a distance between the air outlet and the stored object placed in front of the air outlet based on the image acquired by at least one of the imaging unit and the lower imaging unit. The refrigerator may further include a notification unit that provides a notification to a user if the determination unit determines that the distance between the air outlet and the stored object placed in front of the air outlet is larger than or equal to a predetermined distance.

According to the above configuration, the determination unit determines the distance between the air outlet and the stored object based on the images acquired from the plurality of directions. Furthermore, if the determination unit determines that the distance is larger than or equal to the predetermined distance, the notification unit provides a notification to the user. Therefore, the user can be warned in a case where the flow passage of cold air from the air outlet is blocked.

The present disclosure is not limited to the embodiments described above, and permits various modifications within the scope indicated in the claims. An embodiment obtained by appropriately combining the technologies disclosed in different embodiments is also included in the technical scope of the present disclosure. Moreover, a new technical feature may be formed by combining the technologies disclosed in the respective embodiments.

The present disclosure contains subject matter related to that disclosed in Japanese Priority Patent Application JP 2018-125221 filed in the Japan Patent Office on Jun. 29, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A refrigerator comprising:

a storage compartment having a storage region that stores a stored object;

a door that opens and closes the storage compartment;

an air outlet that is provided in a rear wall of the storage region and that blows cold air into the storage region;

an imaging unit that is provided at an inner side of the door at a position higher than or equal to a height of the air outlet and that acquires an image of the storage region from the door; and a determination unit that determines whether or not a passage of cold air from the air outlet to the imaging unit is ensured without being blocked by the stored object stored in the storage region based on a result of determining whether the image acquired by the imaging unit includes an image of the rear wall.

2. The refrigerator according to claim 1, wherein the air outlet has a shape identifiable by the determination unit.

3. The refrigerator according to claim 1, wherein the rear wall is provided with a predetermined pattern identifiable by the determination unit.

4. The refrigerator according to claim 1, further comprising:

a mirror that is provided on an upper surface of the storage region and that reflects an upper side from the air outlet relative to the imaging unit.

5. The refrigerator according to claim 1, further comprising:

a lower imaging unit that is provided below the imaging unit at the inner side of the door and that acquires an image of the storage compartment from the door, wherein the storage compartment is divided into a plurality of storage regions by a plurality of translucent trays on which stored objects are placed, wherein the imaging unit acquires an image of a target storage region included in the storage regions and being a storage region including the air outlet, and wherein the lower imaging unit is capable of acquiring an image of the target storage region via the trays from a lower storage region included in the storage regions and located below the target storage region.

6. The refrigerator according to claim 5, wherein the tray that defines a lower end of the target storage region is provided with an optical region near the air outlet, the optical region having optical characteristics that direct a component of light traveling from the target storage region and transmitted through the tray toward the lower imaging unit.

7. The refrigerator according to claim 5, further comprising:

a light radiator that radiates light onto the target storage region from above, wherein the lower imaging unit acquires an image of a shadow formed by the light on the tray that defines a lower end of the target storage region.

8. The refrigerator according to claim 1, wherein the determination unit determines whether an image of at least one of the air outlet and a predetermined region of the rear wall is acquired, and wherein the refrigerator further comprises a notification unit that provides a notification to a user if the determination unit determines that the image of the air outlet or the predetermined region of the rear wall is not acquired.

9. The refrigerator according to claim 5, wherein the determination unit determines a distance between the air outlet and the stored object placed in front of the air outlet based on the image acquired by at least one of the imaging unit and the lower imaging unit, and wherein the refrigerator further comprises a notification unit that provides a notification to a user if the determination unit determines that the distance between the air outlet and the stored object placed in front of the air outlet is larger than or equal to a predetermined distance.

10. The refrigerator according to claim 1, wherein the determination unit determines whether the cold air blown out from the air outlet is capable of flowing to the imaging unit, and the determination unit further determines a passage along which the cold air blown out from the air outlet flows forward is blocked.

* * * * *